US009358785B2

(12) United States Patent
Kawakubo et al.

(10) Patent No.: US 9,358,785 B2
(45) Date of Patent: Jun. 7, 2016

(54) INKJET HEAD HAVING HIGH MECHANICAL STRENGTH AND METHOD OF MANUFACTURING THE SAME

(71) Applicants: KABUSHIKI KAISHA TOSHIBA, Tokyo (JP); TOSHIBA TEC KABUSHIKI KAISHA, Tokyo (JP)

(72) Inventors: Takashi Kawakubo, Yokohama Kanagawa (JP); Kazuhide Abe, Kawasaki Kanagawa (JP); Yasushi Tomizawa, Fuchu Tokyo (JP); Ryuichi Arai, Numazu Shizuoka (JP); Ryutaro Kusunoki, Mishima Shizuoka (JP); Osamu Takagi, Chofu Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/574,016

(22) Filed: Dec. 17, 2014

(65) Prior Publication Data

US 2016/0052272 A1 Feb. 25, 2016

(30) Foreign Application Priority Data

Aug. 20, 2014 (JP) ..... 2014-167528

(51) Int. Cl.
*B41J 2/045* (2006.01)
*B41J 2/14* (2006.01)

(52) U.S. Cl.
CPC ..... *B41J 2/14298* (2013.01); *B41J 2/1404* (2013.01); *B41J 2/1433* (2013.01); *B41J 2/14274* (2013.01)

(58) Field of Classification Search
CPC .... B41J 2/1404; B41J 2/14201; B41J 2/1433; B41J 2/1607; B41J 2/14274; B41J 2/14298
See application file for complete search history.

(56) References Cited

U.S. PATENT DOCUMENTS

| | | | | |
|---|---|---|---|---|
| 6,474,785 | B1 | 11/2002 | Koegler, III et al. | |
| 6,676,244 | B2 * | 1/2004 | Kwon et al. | 347/45 |
| 2003/0035029 | A1 | 2/2003 | Lee et al. | |
| 2004/0075722 | A1 | 4/2004 | Lee et al. | |
| 2011/0037813 | A1 * | 2/2011 | Nakatani | 347/70 |
| 2013/0222481 | A1 | 8/2013 | Yokoyama et al. | |
| 2015/0085022 | A1 | 3/2015 | Kawakubo et al. | |

FOREIGN PATENT DOCUMENTS

| | | | |
|---|---|---|---|
| JP | H05-177832 | A | 7/1993 |
| JP | 2002103633 | A | 4/2002 |
| JP | 2002-225277 | A | 8/2002 |

(Continued)

OTHER PUBLICATIONS

Japanese Office Action with English translation, Patent Application No. JP 2014-167528, dated Aug. 25, 2015, 6 pages.

*Primary Examiner* — Juanita D Jackson
(74) *Attorney, Agent, or Firm* — Patterson & Sheridan, LLP

(57) ABSTRACT

According to one embodiment, an inkjet head includes a nozzle plate including a first surface, a second surface opposite to the first surface, a through hole configured to make the first surface communicate with the second surface, and a cylindrical member integrally extending from the second surface by extending the through hole. An ink pressure chamber communicating with the cylindrical member and the through hole is provided on the second surface side of the nozzle plate. This inkjet head also includes an actuator which discharges ink in the ink pressure chamber from the through hole by displacing the nozzle plate.

6 Claims, 22 Drawing Sheets

(56) References Cited

FOREIGN PATENT DOCUMENTS

| | | | |
|---|---|---|---|
| JP | 2004-136679 | A | 5/2004 |
| JP | 2013067026 | A | 4/2013 |
| JP | 2013194963 | A | 9/2013 |
| JP | 2013208900 | A | 10/2013 |
| JP | 2015-058666 | A | 3/2015 |

* cited by examiner

INKJET HEAD HAVING HIGH MECHANICAL STRENGTH AND METHOD OF MANUFACTURING THE SAME

CROSS-REFERENCE TO RELATED APPLICATION

This application is based upon and claims the benefit of priority from Japanese Patent Application No. 2014-167528, filed Aug. 20, 2014; the entire contents of which are incorporated herein by reference.

FIELD

Embodiments described herein relate generally to an inkjet head and a method of manufacturing an inkjet head.

BACKGROUND

Conventionally, as an inkjet head, there is known a head of a type in which a nozzle plate having a plurality of nozzle orifices is provided with a plurality of piezoelectric elements. Each piezoelectric element displaces a portion of the nozzle plate around the corresponding nozzle orifice in the thickness direction to change the pressure of the ink pressure chamber communicating with the nozzle orifice. This pressure change discharges ink from the nozzle orifice.

As the nozzle plate is thinned to enable each piezoelectric element to displace the nozzle plate, the length of the nozzle orifice decreases. Shortening the nozzle orifice will present a possibility that the movement of the ink meniscus may generate air bubbles in the nozzle orifice to result in unstable discharge of an ink droplet.

For this reason, there has been developed a head including nozzle extension portions for extending the nozzle length on the ink pressure chamber side of a nozzle plate (see, for example, Japanese Patent Laid-Open No. 2013-67026).

It is, however, difficult to position the nozzle extension portions with respect to the nozzle orifices. This makes it difficult to manufacture a head. In addition, such nozzle extension portions are provided separately from a nozzle plate, and hence have low mechanical strength.

Therefore, there have been demands for the development of an easily-manufactured, low-profile inkjet head having high mechanical strength.

DETAILED DESCRIPTION

According to one embodiment, an inkjet head includes a nozzle plate including a first surface, a second surface opposite to the first surface, a through hole configured to make the first surface communicate with the second surface, and a cylindrical member integrally extending from the second surface by extending the through hole. An ink pressure chamber communicating with the cylindrical member and the through hole is provided on the second surface side of the nozzle plate. This inkjet head also includes an actuator which discharges ink in the ink pressure chamber from the through hole by displacing the nozzle plate.

Various embodiments will be described hereinafter with reference to the accompanying drawings.

Figure 1:
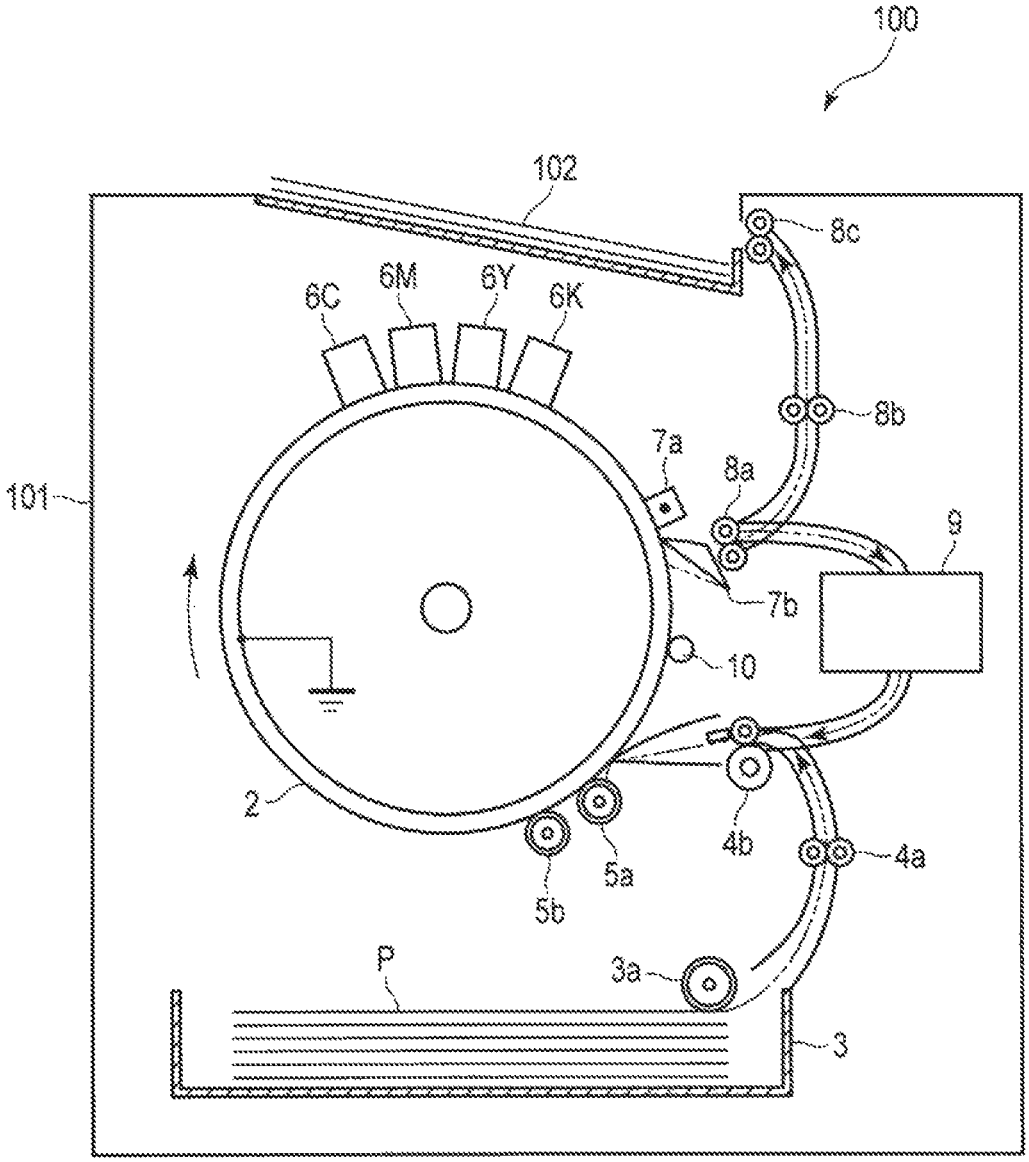
FIG. 1 is a schematic view showing an inkjet printer according to an embodiment.

FIG. 1 is a schematic view showing an inkjet printer 100 (to be simply referred to as the printer 100 hereinafter) according to an embodiment.

The printer 100 includes a housing 101. A holding roller 2 is provided in the housing 101 so as to be rotatable in the arrow direction. A paper fee cassette 3 storing sheets P is provided below the holding roller 2. A paper delivery tray 102 is provided on the upper end of the housing 101.

Two convey roller pairs 4*a* and 4*b* convey the sheet P picked up by a pickup roller 3*a* from the paper feed cassette 3 to the holding roller 2. A press roller 5*a* presses the sheet P conveyed to the holding roller 2 against the surface of the holding roller 2. A charge roller 5*b* charges the sheet P, which is then electrostatically attracted to the surface of the holding roller 2. The holding roller 2 rotates to further convey the sheet P. The holding roller 2 is formed from aluminum in a cylindrical shape and is grounded.

The sheet P conveyed by the rotation of the holding roller 2 passes through inkjet heads 6C, 6M, 6Y, and 6K of the respective colors. The inkjet heads 6C, 6M, 6Y, and 6K of the respective colors respectively discharge cyan, magenta, yellow, and black inks to superimpose images of the respective colors on the sheet P. The inkjet heads 6C, 6M, 6Y, and 6K have the same structure, and hence will sometimes be simply referred to as inkjet heads 6 in the following description.

A destaticizing charger 7*a* destaticizes the sheet P on which a color image is formed after passing through the inkjet heads 6C, 6M, 6Y and 6K of the respective colors. A separation gripper 7*b* separates the sheet P from the surface of the holding roller 2. The sheet P separated from the holding roller 2 is delivered onto the paper delivery tray 102 through three delivery roller pairs 8*a*, 8*b*, and 8*c*.

Alternatively, when forming images on the two surfaces of the sheet P, the sheet P separated from the holding roller 2 is sent to a reversing unit 9 through the delivery roller pair 8*a*. The reversing unit 9 vertically reverses the sheet P by reversing the conveying direction of the sheet P and feeding out it the convey roller pair 4*b*. The convey roller pair 4*b* re-feeds the reversed sheet P to the holding roller 2.

A cleaning roller 10 cleans the holding roller 2 after the sheet P is separated from it.

Figure 2:
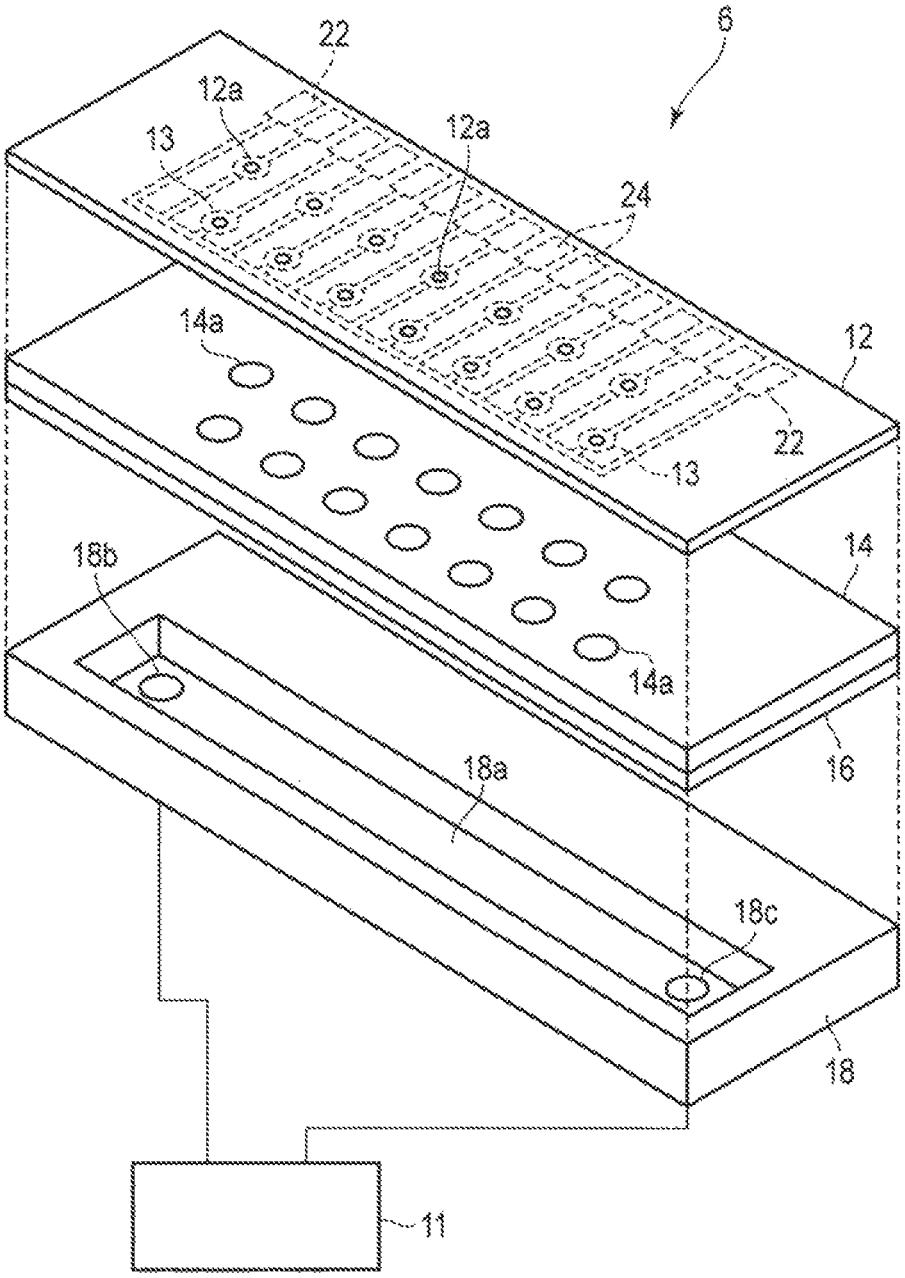
FIG. 2 is an exploded perspective view showing an inkjet head incorporated in the inkjet printer in FIG. 1.

FIG. 2 is an exploded perspective view of the inkjet head 6. The inkjet head 6 is a piezoelectric MEMS type head.

The inkjet head 6 includes a nozzle plate 12, a pressure chamber plate 14, a back plate 16, and an ink channel block 18. The inkjet head 6 is mounted in a posture so as to make the first surface (the upper surface in FIG. 2) of the nozzle plate 12 face the surface of the holding roller 2. Note that, as will be described later, the nozzle plate 12 is forced integrally with the pressure chamber plate 14, and is not separate it as shown in FIG. 2 in practice. In this case, for the sake of a simple explanation, they are shown in a separated state.

The nozzle plate 12 includes a plurality of nozzle orifices 12*a* for discharging ink. Each nozzle orifice 12*a* is a through hole extending through the nozzle plate 12 so as to make the first surface (the upper surface in FIG. 2) communicate with the second surface (not shown) of the nozzle plate 12. Although FIG. 2 shows the 14 nozzle orifices 12*a* arranged in two lines, more nozzle orifices 12*a* are arranged in a plurality of lines in practice. That is, for the sake of a simple explanation, FIG. 2 shows the nozzle orifices 12*a* smaller in number than the actual number.

The pressure chamber plate 14 includes a plurality of ink pressure chambers 14*a* respectively facing the nozzle orifices 12*a*. Each ink pressure chamber 14*a* extends through the pressure chamber plate 14. The back plate 16 includes a plurality of ink passage holes 16*a* (not shown in FIG. 2) (see FIG. 4) respectively corresponding to the plurality of ink pressure chambers 14*a*. Each ink passage hole 16*a* also extends through the back plate 16. The ink channel block 18 includes an ink reservoir 18*a* communicating with the plurality of ink passage holes 16*a*. The bottom of the ink reservoir 18*a* is provided with an ink inlet 18*b* and an ink outlet 18*c* which are connected to an ink tank 11.

The ink supplied from the ink tank 11 flows into the ink reservoir 18*a* through the ink inlet 18*b* and returns to the ink tank 11 through the ink outlet 18*c*. That is, the ink circulates between the ink tank 11 and the ink reservoir 18*a*. Part of the ink circulating in the ink reservoir 18*a* is supplied to the plurality of ink pressure chambers 14*a* of the pressure chamber plate 14 through the plurality of ink passage holes 16*a* of the back plate 16. The ink supplied to each ink pressure chamber 14*a* is discharged through the corresponding nozzle orifice 12*a* of the nozzle plate 12 by the operation of a piezoelectric element 13 (actuator) (to be described below).

The first surface of the nozzle plate 12 is provided with the plurality of piezoelectric elements 13 in correspondence with the nozzle orifices 12*a*. Each piezoelectric element 13 is displaced in the thickness direction when a driving voltage is applied to it. As the piezoelectric element 13 is displaced, a portion of the nozzle plate 12 around the nozzle orifice 12*a* also is displaced in the thickness direction. This changes the volume of the ink pressure chamber 14*a*. When the volume of the ink pressure chamber 14*a* changes in this manner, the pressure in the ink pressure chamber 14*a* changes. With this pressure change, ink is discharged from the nozzle orifice 12*a*.

(First Embodiment)

Figure 3:
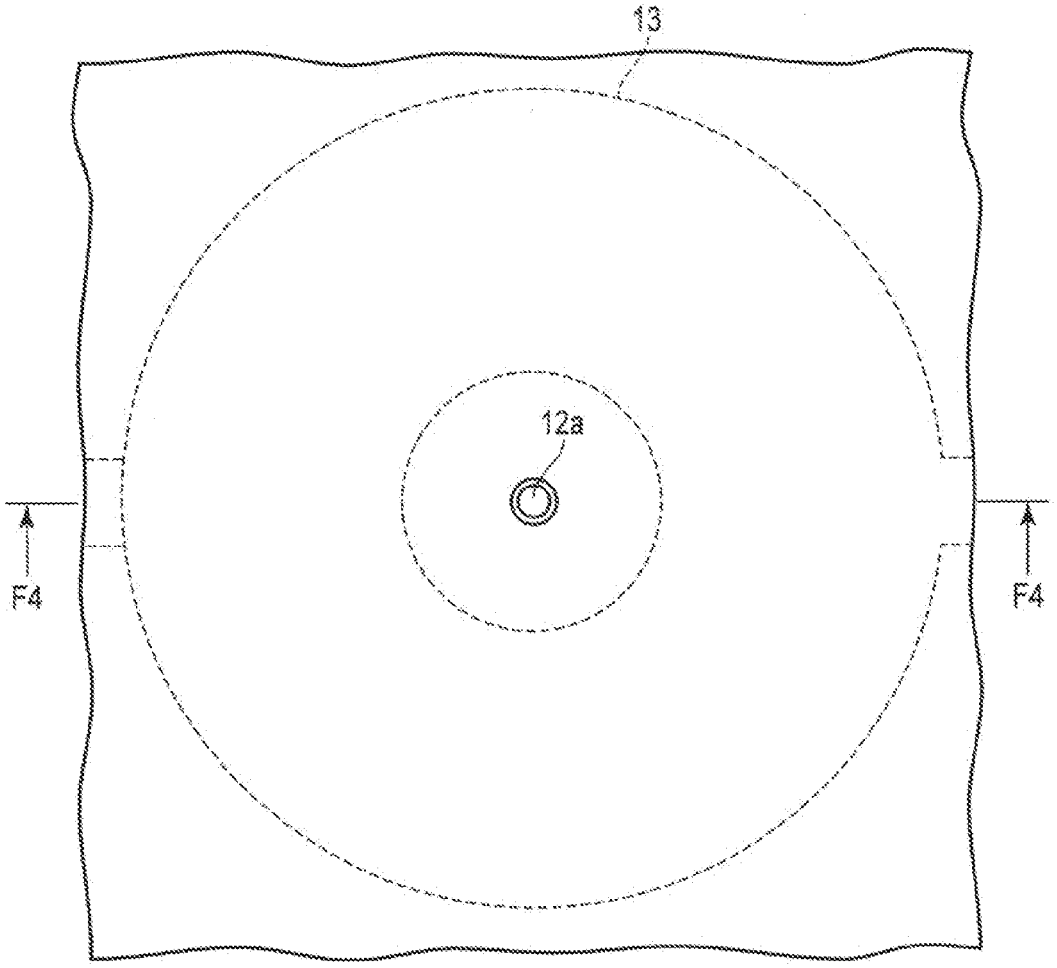
FIG. 3 is a partially enlarged plan view of the main portion of an inkjet head according to the first embodiment.
Figure 4:
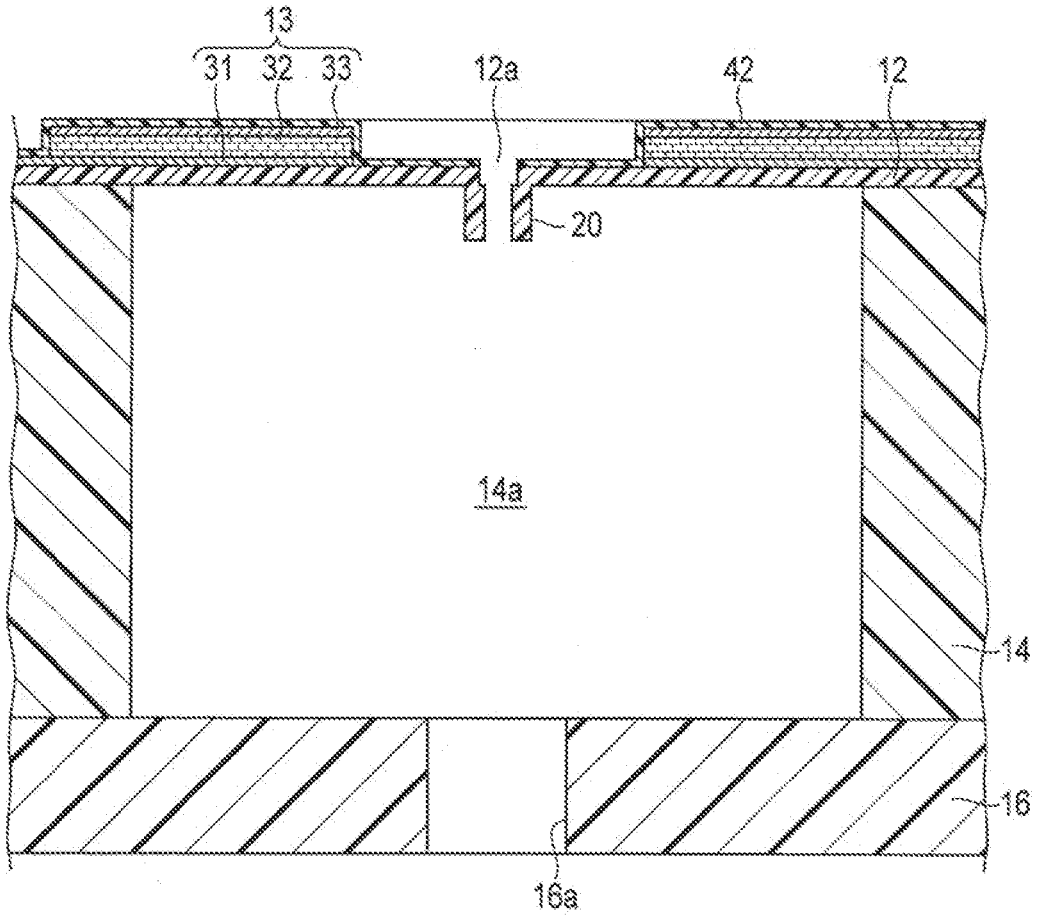
FIG. 4 is a partially enlarged sectional view of the inkjet head taken along F4-F4 in FIG. 3.

FIG. 3 is a partially enlarged plan view of the main part of an inkjet head 6 according to the first embodiment, that is, a structure around one nozzle orifice 12*a* when viewed from the ink discharging direction. FIG. 4 is a partially enlarged sectional view of the inkjet head 6 taken along F4-F4 in FIG. 3. For the sake of illustrative simplicity, FIG. 4 does not show an ink channel block 18. Note that in a plurality of embodiments and modifications to be described below, the overall arrangement of the head will be described, focusing on one nozzle orifice 12*a*.

The inkjet head 6 includes a nozzle plate 12 formed from silicon oxide film, a piezoelectric element 13 (actuator) stacked on the first surface of the nozzle plate 12, a pressure chamber plate 14 overlaying the second surface of the nozzle plate 12, a back plate 16 overlaying the reverse surface of the pressure chamber plate 14, and the ink channel block 18 (not shown in FIG. 3) overlaying the reverse surface of the back plate 16.

The nozzle plate 12 includes a nozzle 20 (cylindrical member) continuously and integrally extending from the second surface by extending the nozzle orifice 12*a*. That is, the nozzle 20 is formed from the same material as that for the nozzle plate 12, that is, a silicon oxide film, and is formed simultaneously with the nozzle plate 12. The nozzle 20 has an almost cylindrical shape, is arranged coaxially with the nozzle orifice 12*a*, and extends almost vertically in a direction away from the second surface of the nozzle plate 12.

The nozzle plate 12 including the nozzle 20 is formed by oxidizing the surface of a silicon substrate by heating, as will be described later. Alternatively, the nozzle plate 12 including the nozzle 20 can also be formed by, for example, a CVD method. The nozzle plate 12 in this embodiment is formed from a silicon oxide film (silicon dioxide film) having a thickness of 1 μm to 5 μm.

The silicon oxide film is preferably amorphous to implement uniform deformation of the nozzle plate 12. In addition, the nozzle plate 12 is preferably formed from a silicon oxide film from the viewpoint of easiness in manufacturing a film having a stable composition and characteristics. Furthermore, the nozzle plate 12 is preferably formed from a silicon oxide film in terms of good consistency with a conventional semiconductor manufacturing process.

The piezoelectric element 13 includes a lower electrode 31, a piezoelectric film 32, and an upper electrode 33. The lower electrode 31 is stacked on the first surface of the nozzle plate 12. The piezoelectric film 32 is stacked on the lower electrode 31. The upper electrode 33 is stacked on the piezoelectric film 32. The piezoelectric element 13 is a thin film having an almost annular shape which is provided around the nozzle orifice 12*a*, as shown in FIG. 3.

As shown in FIG. 2, the lower electrode 31 is connected to a common electrode 22 through a wiring. The upper electrode 33 is connected to an individual electrode 24 through a wiring. The upper electrode 33 is elongated together with the piezoelectric film 32 and the lower electrode 31 to serve as part of a wiring. The piezoelectric film 32 is sandwiched between the lower electrode 31 and the upper electrode 33.

The piezoelectric film 32 is preferably made of a piezoelectric material having a large electrostrictive constant such as lead zirconate titanate ($Pb(Zr, Ti)O_3$, PZT). When using PZT for the piezoelectric film 32, it is preferable to use a noble metal such as Pt, Au, or Ir or a conductive oxide such as $SrRuO_3$ for the lower electrode 31 and the upper electrode 33. It is possible to use a piezoelectric material suitable for a silicon process, e.g., AlN or $ZrO_2$, for the piezoelectric film 32. In this case, it is possible to use a general electrode material or wiring material such as Al or Cu for the lower electrode 31 and the upper electrode 33.

The piezoelectric element 13 in this embodiment has a size such that a portion near its outer edge portion overlaps an outer circumferential portion of an ink pressure chamber 14*a*, and has the outer edge portion fixed to the nozzle plate 12 outside the ink pressure chamber 14*a*. That is, the diameter of the piezoelectric element 13 is larger than that of the ink pressure chamber 14*a*. For this reason, when a driving voltage is applied between the common electrode 22 and the individual electrode 24, a portion near the center of the piezoelectric element 13 which is not fixed is largely displaced in the thickness direction.

the pressure chamber plate 14 is formed form, for example, a silicon substrate having a thickness of about 100 μm to 600 μm. The ink pressure chamber 14*a* extending through the pressure chamber plate 14 is a cavity to be filled with ink. The two ends of the ink pressure chamber 14*a* in the axial direction are sealed with the nozzle plate 12 and the back plate 16. The back plate 16 is also formed from a silicon substrate. Ink is supplied from an ink reservoir 18*a* to the ink pressure chamber 14*a* through an ink passage hole 16*a* of the back plate 16. The ink pressure chamber 14*a* in this embodiment has an almost cylindrical shape.

The thickness of the pressure chamber plate 14 is preferably about 150 μm to 250 μm. Designing the pressure chamber plate 14 to have such a thickness makes it possible to increase the array density of ink pressure chambers 14*a* while maintaining the rigidity of the partition wall between the two adjacent ink pressure chambers 14*a*.

When applying a driving voltage between the lower electrode 31 and the upper electrode 33 based on a print signal from an external driving circuit (not shown), the piezoelectric film 32 contracts, and the piezoelectric element 13 is displaced in the thickness direction. At this time, as the piezoelectric element 13 is displaced, a portion near the nozzle orifice 12*a* of the nozzle plate 12 is displaced to become convex in the ink discharging direction. This increases the volume of the ink pressure chamber 14*a* to decrease the pressure of the ink pressure chamber 14*a*. As a result, ink flows into the ink pressure chamber 14*a* through the ink passage hole 16*a*.

Subsequently, when the driving voltage between the lower electrode 31 and the upper electrode 33 ceases to be applied, the contraction of the piezoelectric film 32 is canceled, and the nozzle plate 12 returns to the state without any displacement before driving. The volume of the ink pressure chamber 14*a* then decreases, and the pressure on ink in the ink pressure chamber 14*a* increases. As a result, an ink droplet is discharged through the nozzle 20 and the nozzle orifice 12*a*.

As described above, increasing the volume of the ink pressure chamber 14*a* by applying a driving voltage to the piezoelectric element 13 will cause ink to flow into the ink pressure chamber 14*a* through the ink passage hole 16*a* of the back plate 16 and the ink meniscus formed in the nozzle orifice 12*a* will become slightly concave toward the ink pressure chamber 14*a*. In addition, the ink meniscus in the nozzle orifice 12*a* becomes slightly concave toward the ink pressure chamber 14*a* immediately after an ink droplet is discharged front the nozzle orifice 12*a* by stopping applying the driving voltage and restoring the volume of the ink pressure chamber 14*a*.

The inkjet head 6 according to this embodiment includes the nozzle 20 extending from the nozzle orifice 12*a* to the ink pressure chamber 14*a*. For this reason, there is no concern that air will flow into the ink pressure chamber 14*a* even when the ink meniscus becomes concave in the above manner at the time of discharging an ink droplet. Using the inkjet head 6 according to this embodiment, therefore, makes it possible to increase the volume of an ink droplet to be discharged as compared to related art (a head without the nozzle 20).

In addition, using the inkjet head 6 according to this embodiment makes it possible to adjust the position of the ink meniscus before an ink droplet is discharged at the time of applying a driving voltage. This facilitates tone control of changing the size of an ink droplet to he discharged to a desired size. Note that when adjusting the position of the ink meniscus for such tone control, the waveform of a driving voltage to be applied to the piezoelectric element 13 is changed.

The size of the ink pressure chamber 14*a* and the size of the nozzle 20 are optimized in accordance with the amount of ink droplet to be discharged, a discharging speed, and a discharging frequency.

With regard to the length of the nozzle 20, in particular, the shorter the nozzle length, the better, in terms of efficiency, because as the nozzle length increases, the driving efficiency decreases. On the other hand, increasing the nozzle length makes it difficult for air bubbles to enter when the meniscus becomes greatly concave before or after the discharge of ink. In addition, increasing the nozzle length will increase the volume of an ink droplet. Furthermore, increasing the nozzle length facilitates tone control of changing the size of an ink droplet, as described above.

In the inkjet head 6, the meniscus becomes concave by an amount corresponding to the volume of a discharged ink droplet, and hence decreasing the nozzle length will increase the risk of air bubble mixing and the like. In general, the diameter of an ink droplet is nearly equal to a nozzle diameter. Therefore, if it is assumed that the diameter of an ink droplet is equal to the nozzle diameter, the aspect ratio of a meniscus retraction distance/a nozzle diameter is calculated by $$(4/3\cdot\pi r3)/(\pi r2)/(2r)=2/3 \ldots \quad (1)$$

In this case, the aspect ratio is about 0.67.

In addition, the volume of an ink droplet is sometimes increased up to about three fold by raising the driving voltage to be applied to the piezoelectric element 13 or optimizing the waveform or period of the driving voltage. In this case, the aspect ratio is about 2.

That is, using the nozzle 20 with an aspect ratio of 2 can perform tone control of changing the volume of an ink droplet by about three fold. The aspect ratio of the length and the diameter of the nozzle 20 is 0.5 or more to 3 or less, and preferably 0.5 or more to 2 or less.

A method of manufacturing the inkjet head 6 according to the first embodiment having the above structure will be described below with reference to FIGS. 5, 6, 7, 8, 9, 10, and 11.

Figure 5:
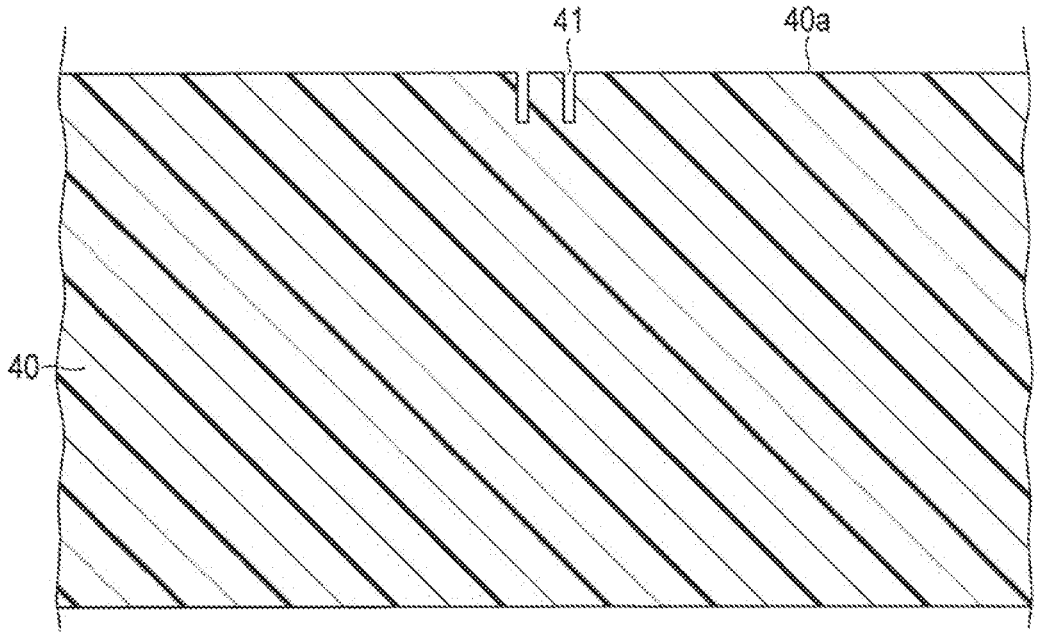
FIG. 5 is a view for explaining a method of manufacturing the inkjet head according to the first embodiment.

As shown in FIG. 5, first of all, a ring-like groove 41 is forced in a flat wafer surface 40*a* (first surface) of a single crystal silicon substrate 40. In this embodiment, the groove 41 is formed nearly perpendicularly to the wafer surface 40*a*. The position and shape (depth and width) of the groove 41 determine the position, length, and thickness of the nozzle 20 to be formed in a subsequent process.

Figure 6:
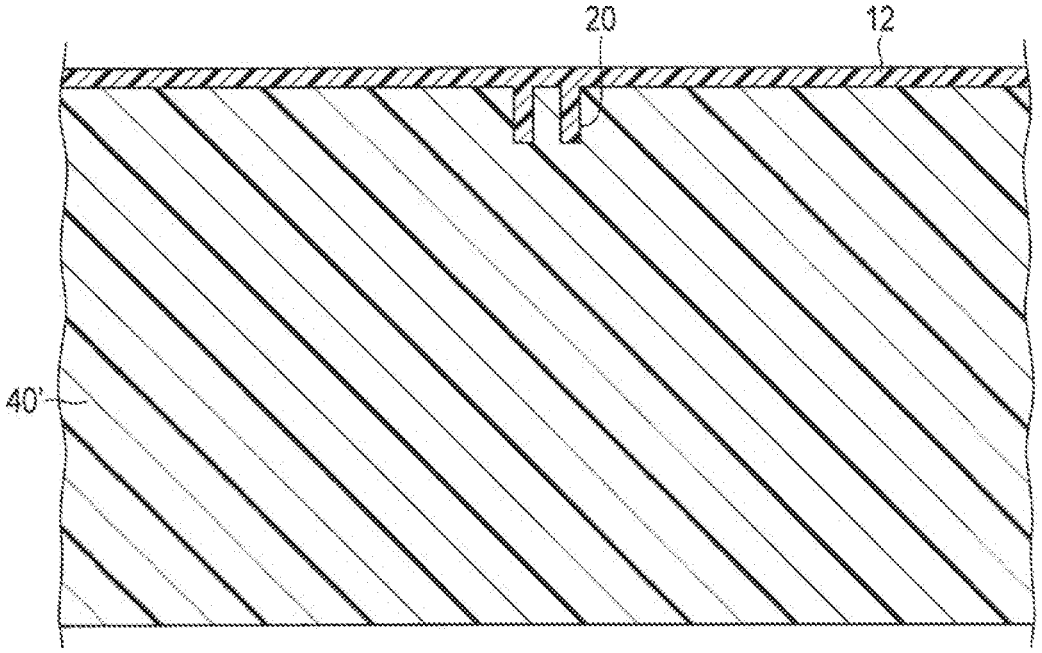
FIG. 6 is a view for explaining the method of manufacturing the inkjet head according to the first embodiment.

As shown in FIG. 6, the wafer surface 40*a* is oxidized by heating to form the nozzle plate 12 formed from a silicon oxide film. As the wafer surface 40*a* is oxidized, the wafer surface 40*a* corrodes and expands. At this time, since the corrosion and expansion ratios of the wafer surface 40*a* are respectively about 45% and about 55%, the thickness (FIG. 6) obtained by adding the thickness of an unoxidized single crystal silicon substrate 40' and the thickness of the nozzle plate 12 becomes slightly larger than the thickness of the single crystal silicon substrate 40 in FIG. 5.

In addition, at this time, the inner surface of the groove 41 is oxidized simultaneously with the oxidation of the wafer surface 40*a*, thus forming the nozzle 20 having a shape corresponding to the shape of the groove 41. In this embodiment, as a result, the groove 41 is filled by the expansion of the silicon oxide film to form the cylindrical nozzle 20 protruding almost perpendicularly from the second surface of the nozzle plate 12. That is, the nozzle 20 can be formed from the same material as that for the nozzle plate 12 integrally and simultaneously with the nozzle plate 12. This can improve the positional accuracy of the nozzle 20 with respect to the nozzle plate 12 and increase the mechanical strength of the nozzle 20.

Note that the wall thickness of the nozzle 20 at this time becomes 2.24 times larger than the width of the groove 41. In other words, the wall thickness of the nozzle 20 can be easily adjusted to a desired thickness by adjusting the width of the groove 41. In addition, the length of the nozzle 20 can be easily adjusted to a desired length by adjusting the depth of the groove 41.

Note that in this embodiment, the nozzle plate 12 and the nozzle 20 are forced by oxidizing the wafer surface 40*a* of the silicon substrate 40 by heating. However, it is possible to use a plasma CVD method, a CVD method using TEOS as a raw material, or the like instead of the thermal oxidation method. In addition, in the embodiment, the nozzle plate 12 and the nozzle 20 are formed by thermal oxidation of the silicon substrate 40. However, it is possible to form them by using both the thermal oxidation method and the plasma method or the CVD method using TEOS as a raw material or the like.

Figure 7:
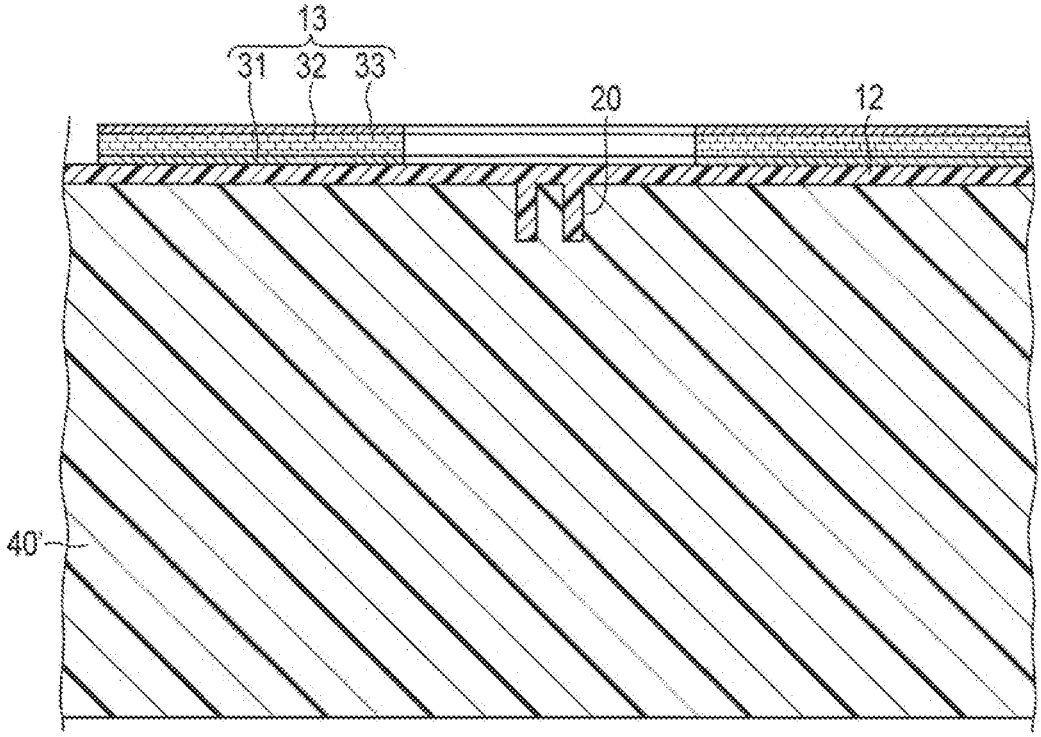
FIG. 7 is a view for explaining the method of manufacturing the inkjet head according to the first embodiment.

As shown in FIG. 7, the annular piezoelectric element 13 is then deposited on the first surface of the nozzle plate 12 on the opposite side to the nozzle 20. When depositing the piezoelectric element 13, the lower electrode 31 made of Ti/Pt is provided first on the first surface of the nozzle plate 12 by sputtering. The piezoelectric film 32 made of PZT is provided on the lower electrode 31 by sputtering. The upper electrode 33 made of Pt is provided on the piezoelectric film 32 by sputtering. The upper electrode 33 and the piezoelectric film 32 are patterned by photolithography and reactive ion etching. The lower electrode 31 is further patterned by photolithography and reactive ion etching.

Figure 8:
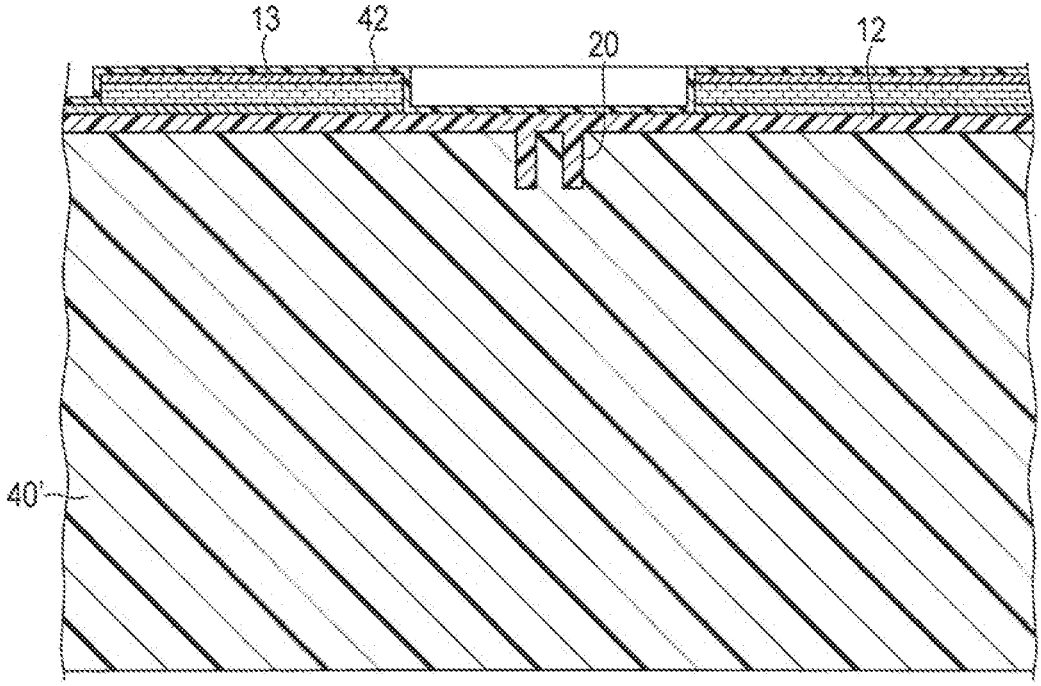
FIG. 8 is a view for explaining the method of manufacturing the inkjet head according to the first embodiment.

As shown in FIG. 8, a water-repellent protective film 42 is then formed so as to cover the entire upper surfaces of the nozzle plate 12 and the piezoelectric element 13.

Figure 9:
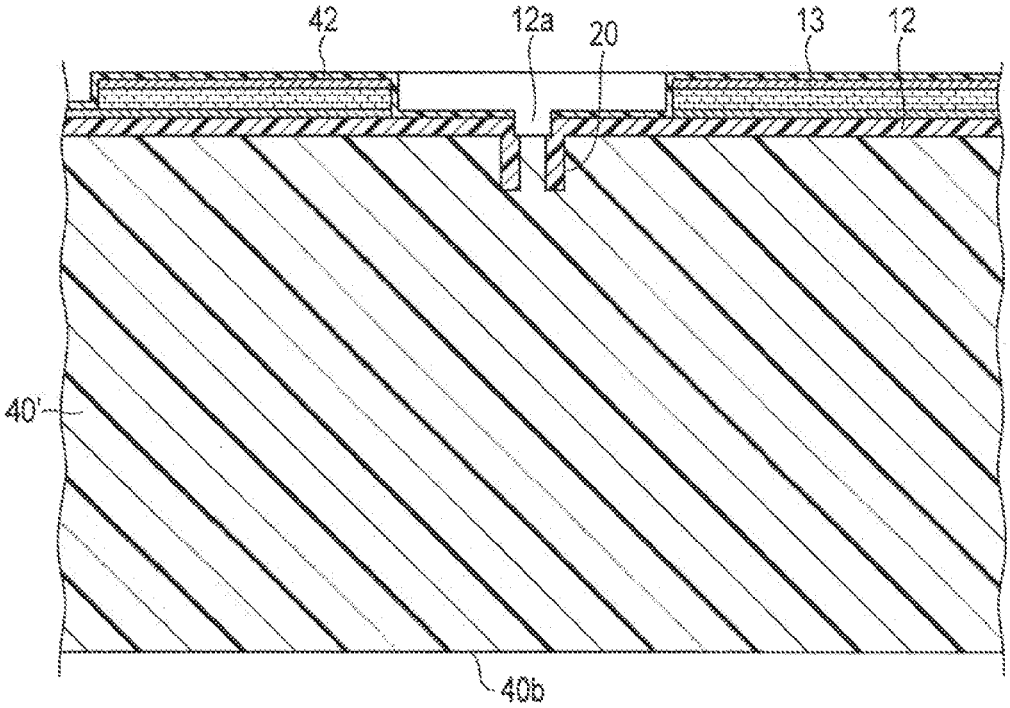
FIG. 9 is a view for explaining the method of manufacturing the inkjet head according to the first embodiment.

As shown in FIG. 9, the protective film 42 and the nozzle plate 12 are then patterned by performing photolithography and reactive ion etching from the outside of the protective film 42, thereby forming the nozzle orifice 12*a* facing the nozzle 20. At this time, the nozzle orifice 12*a* is formed to have a diameter slightly larger than the diameter of a channel inside the nozzle 20.

Figure 10:
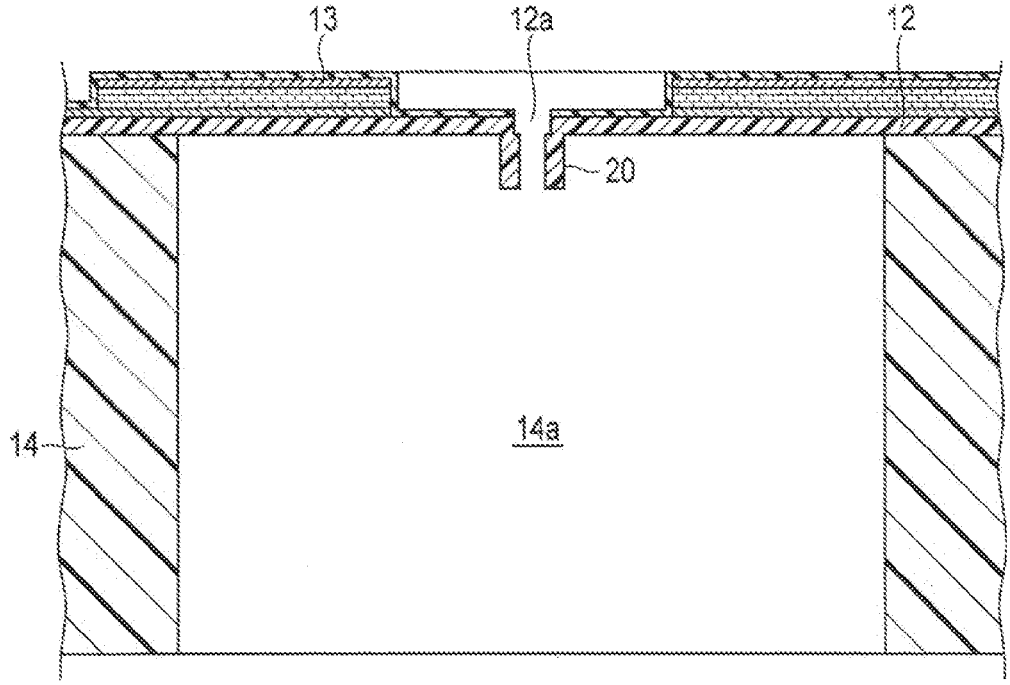
FIG. 10 is a view for explaining the method of manufacturing the inkjet head according to the first embodiment.

As shown in FIG. 10, the ink pressure chamber 14*a* is then formed by partially removing the single crystal silicon substrate 40' from the side of a second surface 40*b* which is opposite to the nozzle plate 12 by backside photolithography and D-RIE. At this time, the silicon material inside the nozzle 20 is also removed to make the nozzle orifice 12*a* communicate with the ink pressure chamber 14*a*.

Figure 11:
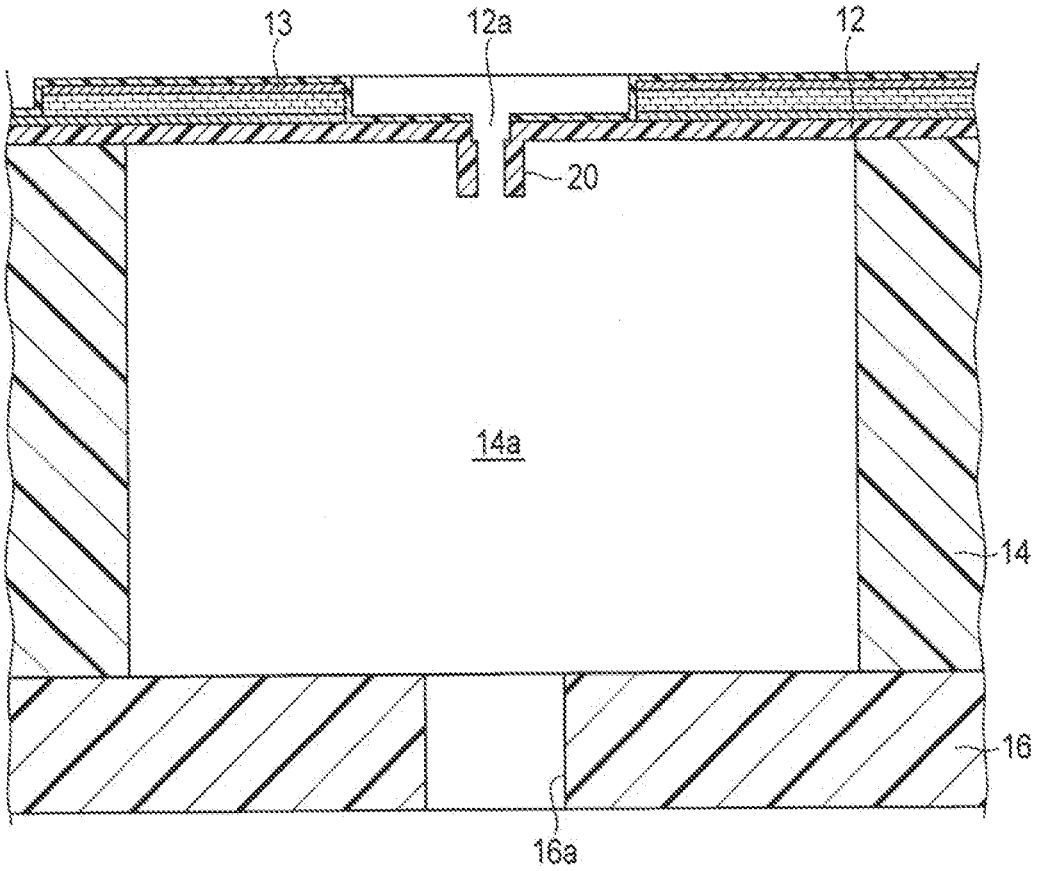
FIG. 11 is a view for explaining the method of manufacturing the inkjet head according to the first embodiment.

As shown in FIG. 11, the back plate 16 is then bonded to the second surface 40*b* of the single crystal silicon substrate 40'. As a bonding method, it is possible to use, for example, a silicon direct bonding method of bonding two substrate surfaces to each other by tightly pressing them in a vacuum atmosphere after cleaning them or a method using an organic adhesive. Thereafter, the ink passage hole 16*a* is formed in the back plate 16 by, for example, a laser.

Note that the above series of film formation and etching steps is not for manufacturing a chip of one inkjet head 6 but is for simultaneously forming many chips on one wafer. After the end of the process, a plurality of inkjet heads 6 can be simultaneously manufactured by dividing one wafer into a plurality of chips.

As described above, according to this embodiment, it is possible to easily manufacture an inkjet head including the nozzle plate 12 integrally having the nozzles 20 by a simple process, thereby providing a low-profile inkjet head with high mechanical strength. Since the nozzle 20 can be forced at the position of the groove 41 of the wafer surface 40*a*, it is possible to improve the positional accuracy of the nozzle 20 and increase the connection strength of the nozzle 20 with respect to the nozzle plate 12.

In addition, according to this embodiment, the nozzle plate 12 and the nozzle 20 into which ink comer into contact can be formed from a chemically stable silicon oxide film. This eliminates the need to consider corrosion by ink. In addition, the embodiment can provide a highly reliable, compact piezoelectric MEMS type inkjet head which facilitates integration and can increase the volume of an ink droplet to be discharged, increase driving energy for discharging an ink droplet, and perform tone control concerning the discharge amount of ink droplet by driving control.

(First Modification of First Embodiment)

Figure 12:
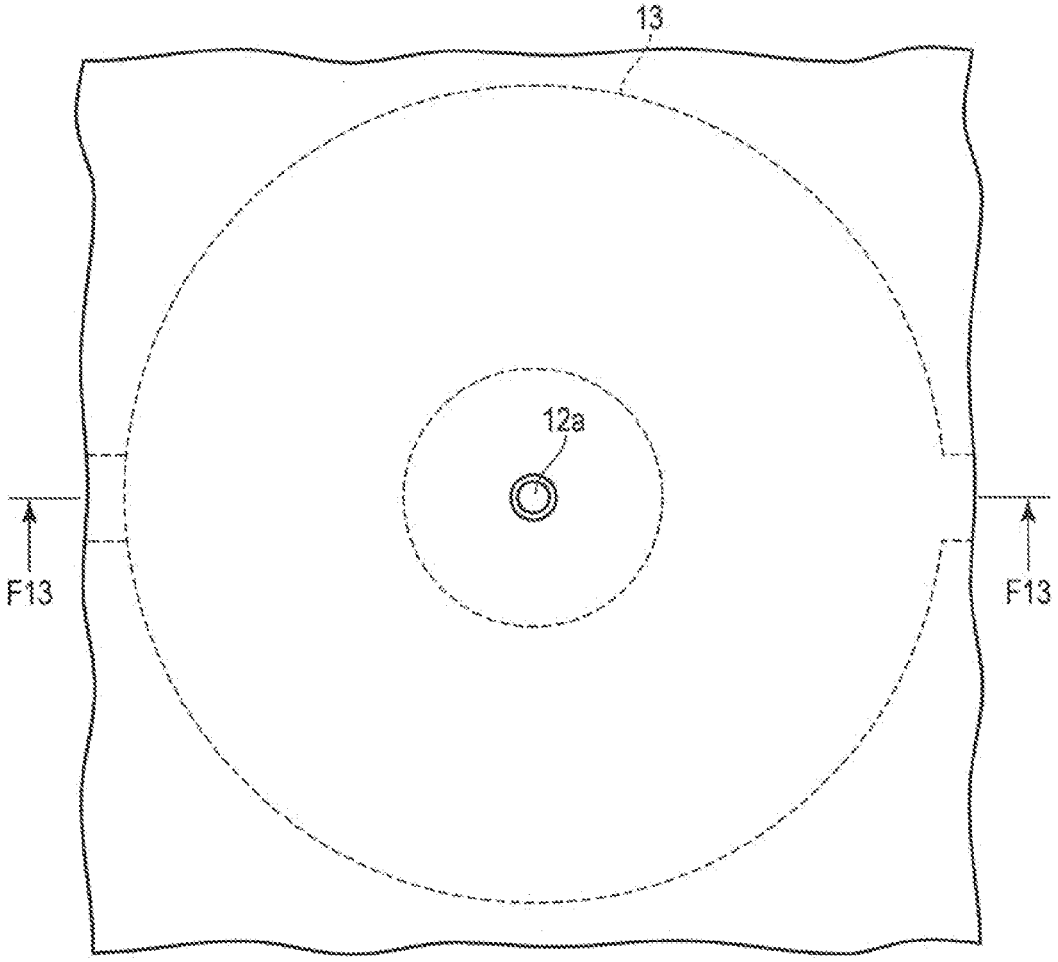
FIG. 12 is a partially enlarged plan view of the main portion of an inkjet head according to the first modification of the first embodiment.
Figure 13:
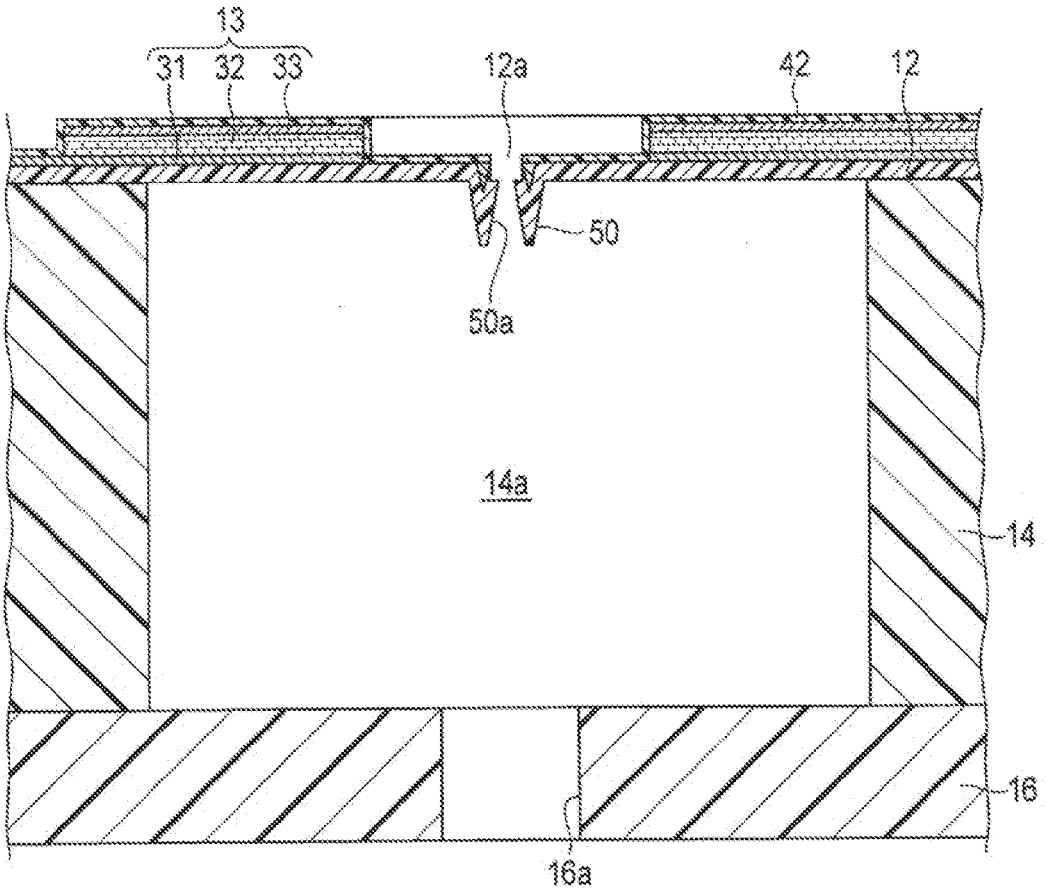
FIG. 13 is a partially enlarged sectional view of the inkjet head taken along F13-F13 in FIG. 12.

FIG. 12 is a partially enlarged plan view of an inkjet head 6' according to this modification when viewed from the ink discharging direction. FIG. 13 is a partially enlarged sectional view of the inkjet head 6' taken along F13-F13 in FIG. 12.

The inkjet head 6' according to this modification has the same structure as that of the inkjet head 6 according to the first embodiment described above except for the shape of each nozzle integrally protruding from the second surface of the nozzle plate 12. That is, a nozzle 50 in the modification has a tapered ink channel 50*a* whose sectional area gradually decreases toward the nozzle orifice 12*a*. Therefore, the same reference numerals denote constituent elements having the same functions as those in the first embodiment, and a detailed description of them will be omitted.

When discharging an ink droplet from the nozzle orifice 12*a* by applying a driving voltage to the piezoelectric element 13 of the inkjet head 6' according to this modification to displace the nozzle plate 12 in the thickness direction, the ink channel 50*a* of the nozzle 50 preferably has a tapered shape which gradually sharpens toward the nozzle orifice 12*a* as shown in FIG. 13. That is, ink flowing toward the nozzle orifice 12*a* through the tapered ink channel 50*a* is compressed to gradually increase in flow velocity. This makes at easy to discharge an ink droplet.

A method of manufacturing the inkjet head 6' according to this modification will be described below. Note that a description of the same manufacturing steps as those for the inkjet head 6 according to the first embodiment will be omitted.

Figure 14:
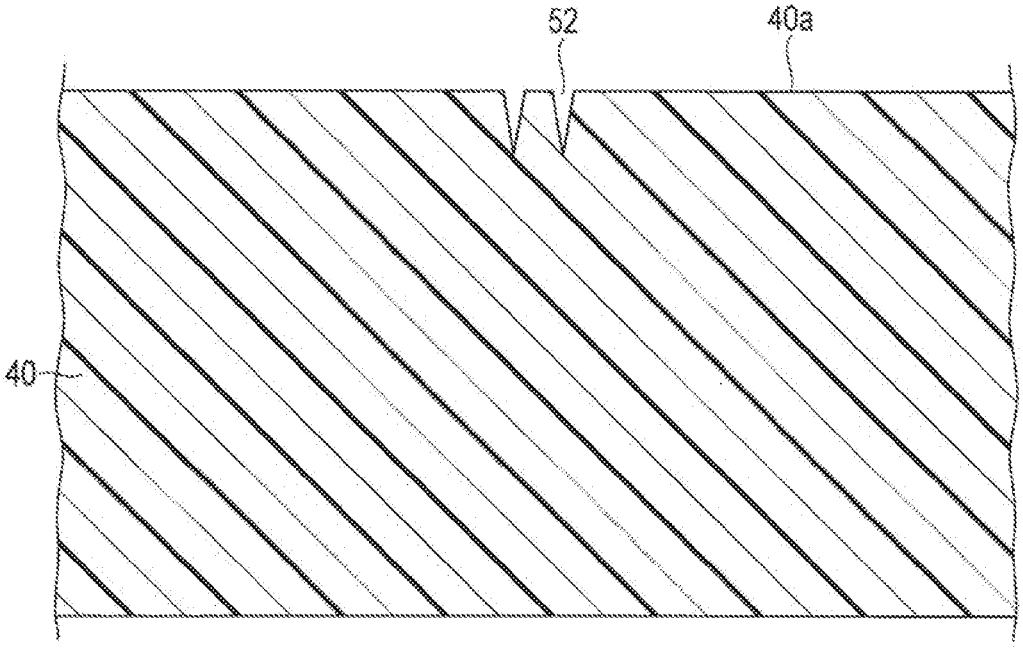
FIG. 14 is a view for explaining a method of manufacturing the inkjet head according to the first modification.

First of all, as shown in FIG. 14, a ring-like groove 52 with a V-shaped cross-section is formed in the wafer surface 40*a* of the single crystal silicon substrate 40.

Figure 15:
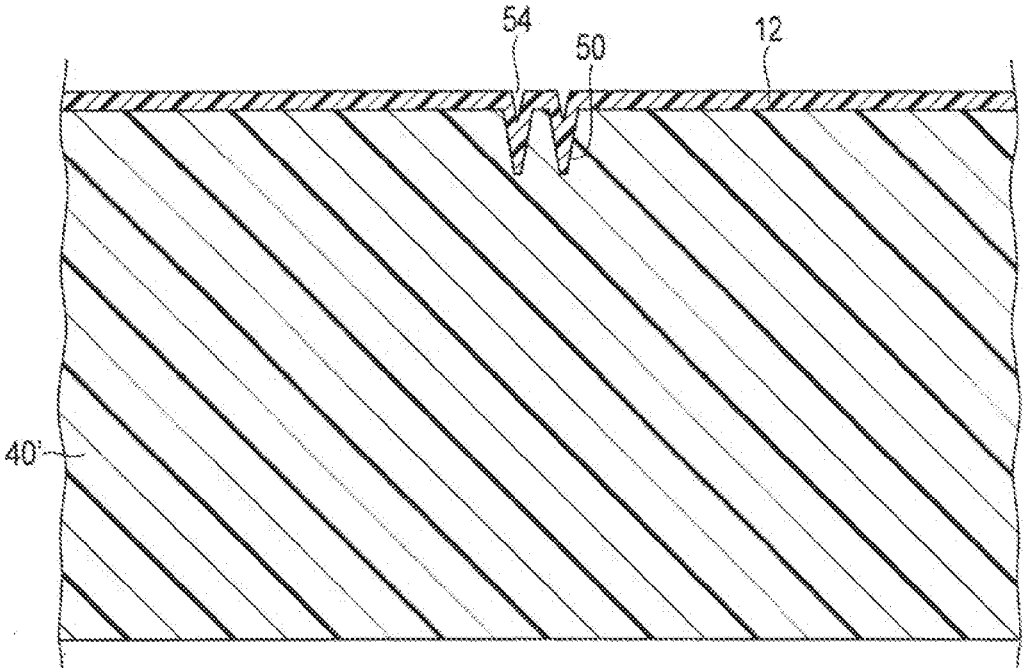
FIG. 15 is a view for explaining the method of manufacturing the inkjet head according to the first embodiment.

As shown in FIG. 15, the nozzle plate 12 and the nozzle 50 are then simultaneously formed from a silicon oxide film by oxidizing the wafer surface 40*a* by heating. At this time, although the bottom portion of the groove 52 is filled with an oxide film, a ring-like space 54 with a V-shaped cross-section like that shown in FIG. 14 is sometimes formed on the wide opening side of the groove 52.

Figure 16:
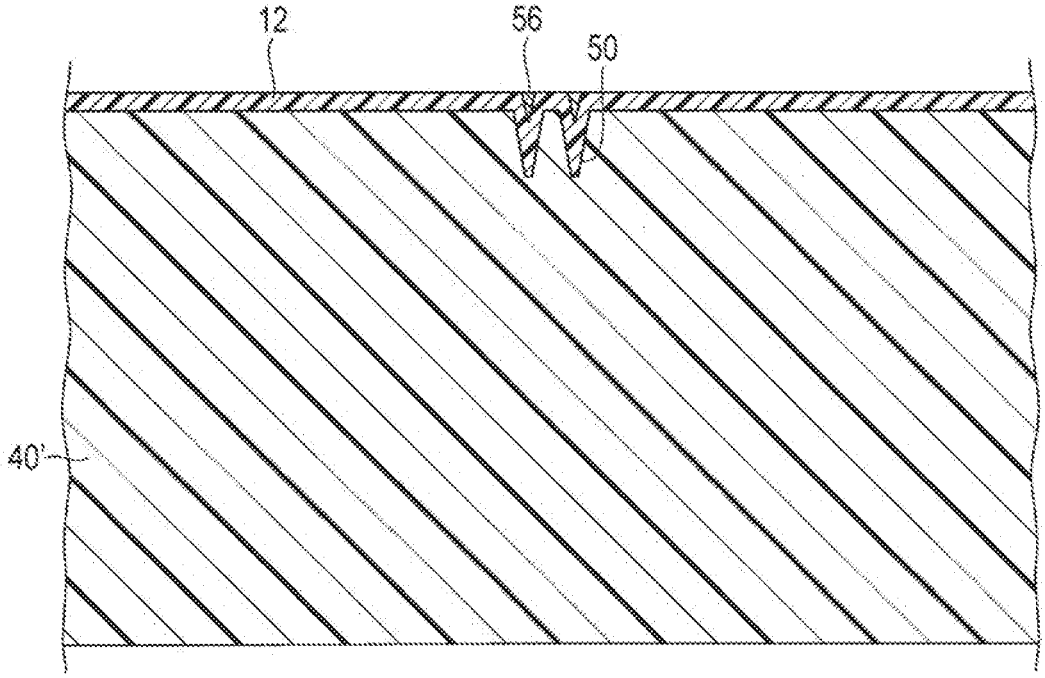
FIG. 16 is a view for explaining the method of manufacturing the inkjet head according to the first embodiment.

When the space 54 is formed, as shown in FIG. 16, the space 54 is filled by coating the entire first surface of the nozzle plate 12 with an organic resin or inorganic resin by a spin-on method, and the resin is etched back upon curing, thereby filling the space 54 with a filling material 56. Note that as the filling material 56, it is possible to use an oxide film or nitride film formed by a CVD method instead of an organic resin or inorganic resin used in the above spin-on method.

The subsequent steps are the same as those in the method of manufacturing the inkjet head 6 according to the first embodiment described with reference to FIGS. 7, 8, 9, 10, and 11.

(Second Modification of First Embodiment)

Figure 17:
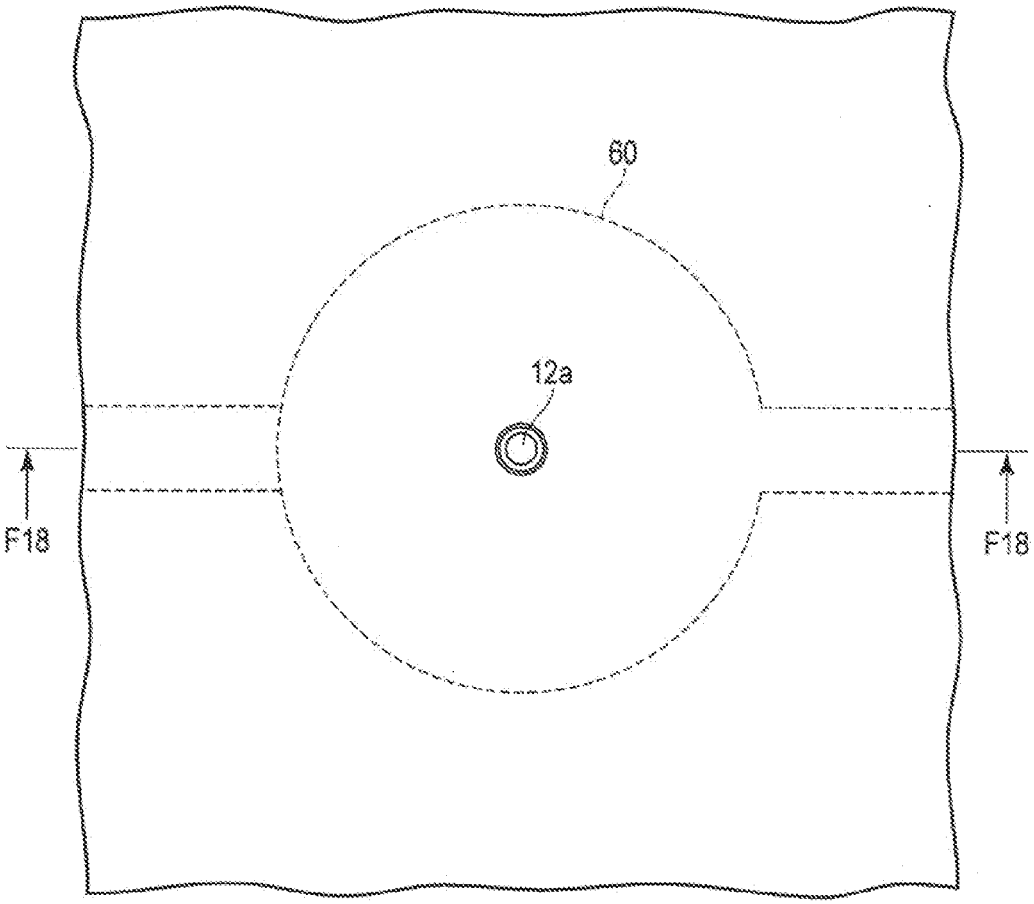
FIG. 17 is a partially enlarged plan view of the main portion of an inkjet head according to the second modification of first embodiment.
Figure 18:
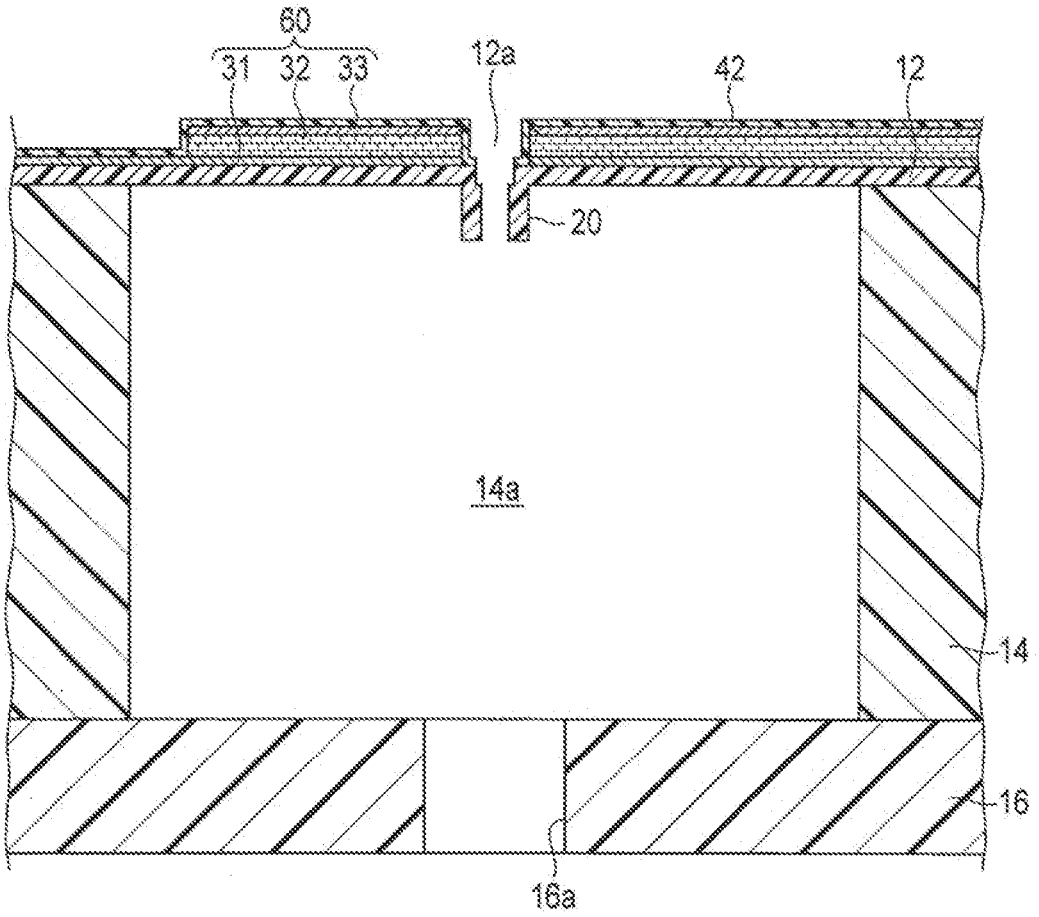
FIG. 18 is a partially enlarged sectional view of the inkjet head taken along F18-F18 in FIG. 17.

FIG. 17 is a partially enlarged plan view showing an inkjet head 6" according to the second modification of the first embodiment when viewed from the ink discharging direction. FIG. 18 is a partially enlarged sectional view of the inkjet head 6" taken along F18-F18 in FIG. 17.

The inkjet head 6" according to this modification has the same structure as that of the inkjet head 6 according to the first embodiment described above except for the shape of each piezoelectric element provided on the first surface of the nozzle plate 12. That is, the inkjet head 6" according to the modification has a structure in which a piezoelectric element 60 formed by stacking the lower electrode 31, the piezoelectric film 32, and the upper electrode 33 is laid out near the center, that is, near the nozzle orifice 12*a*. Therefore, the same reference numerals denote constituent elements having the same functions as those in the first embodiment, and a detailed description of them will be omitted.

In order to perform deforming/driving of the nozzle plate 12 by using a piezoelectric element, it is preferable to form the piezoelectric element near the center or circumference of the ink pressure chamber 14*a*. The inkjet head 6 according to the first embodiment has the piezoelectric element 13 provided near the circumference where it overlaps a peripheral portion of the ink pressure chamber 14*a*. In contrast to this, the inkjet head 6" according to this modification has the piezoelectric element 60 laid out near the center where it does not overlap a peripheral portion of the ink pressure chamber 14*a*. In other words, the piezoelectric element 60 according to the modification has an outer diameter smaller than the diameter of the ink pressure chamber 14*a*.

When the piezoelectric element 60 is arranged near the center of the ink pressure chamber 14*a* as in this modification, it is possible to slightly increase the driving force of the nozzle plate 12 upon application of a driving voltage to the piezoelectric element 60 as compared with the case in which the piezoelectric element 13 is arranged near the circumference as in the first embodiment. This enables the inkjet head 6" according to the modification to suppress a power consumption. In addition, the size of the piezoelectric element 60 can be reduced as compared to the first embodiment, and hence the head can be downsized.

Note that the inkjet head 6" according to this modification also has the nozzle 20 forced from a silicon oxide film, which integrally protrudes from the second surface of the nozzle plate 12. Therefore, the inkjet head 6" according to the modification has the same effects as those of the inkjet head 6 according to the first embodiment.

(Second Embodiment)

Figure 19:
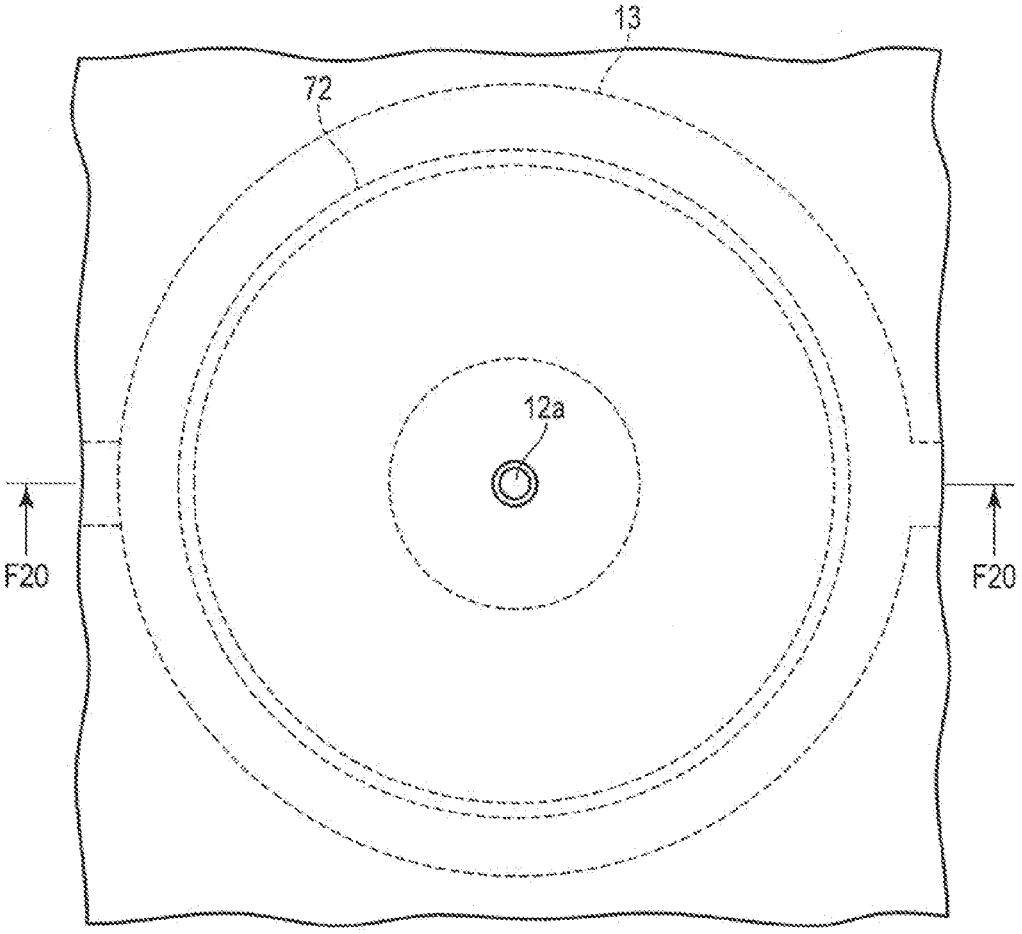
FIG. 19 is a partially enlarged plan view of the main portion of an inkjet head according to the second embodiment.
Figure 20:
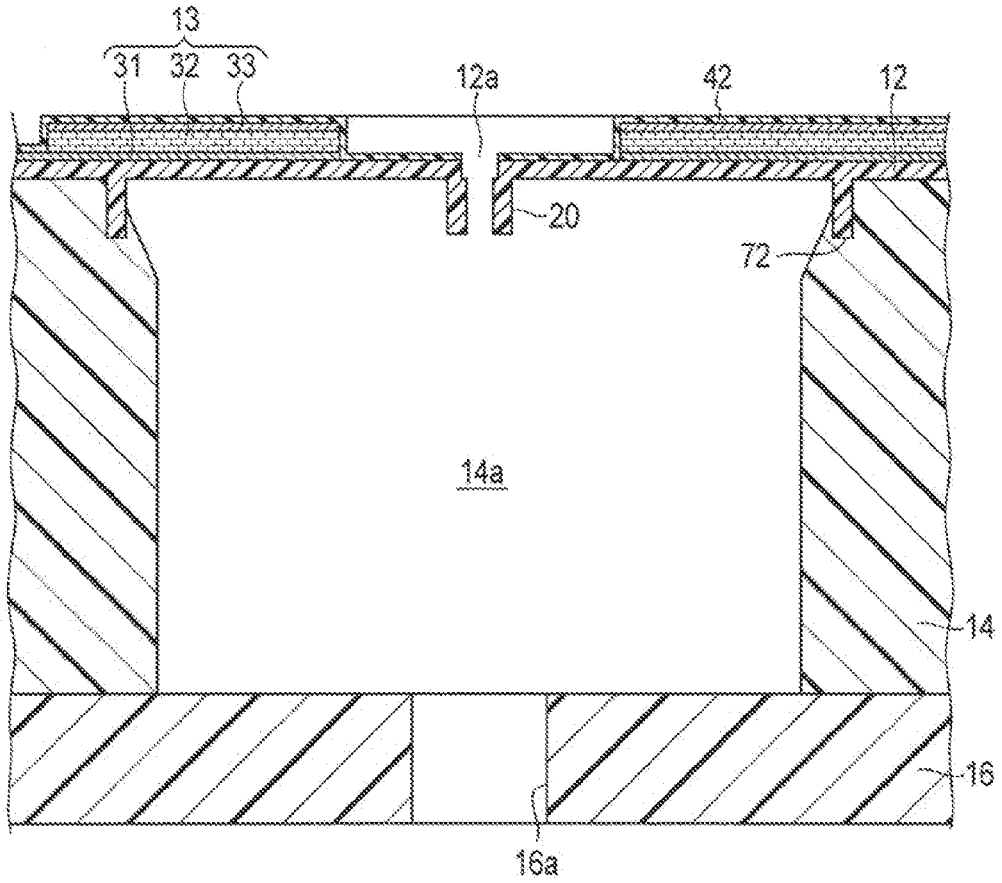
FIG. 20 is a partially enlarged sectional view of the inkjet head taken along F20-F20 in FIG. 19.

FIG. 9 is a partially enlarged plan view showing an inkjet head 70 according to the second embodiment when viewed from the ink discharging direction. FIG. 20 is a partially enlarged sectional view of the inkjet head 70 taken along F20-F20 in FIG. 19.

The inkjet head 70 according to this embodiment has a structure having a cylindrical frame portion 72 (defining frame) integrally protruding from the second surface of a nozzle plate 12. The frame portion 72 is provided to define the inner diameter of an ink pressure chamber 14*a*. Other arrangements are the same as those of the inkjet head 6 according to the first embodiment described above. Therefore, the same reference numerals denote constituent elements having the same functions as those in the first embodiment, and a detailed description of them will be omitted.

As described in the first embodiment, when forming the ink pressure chamber 14*a* in a single crystal silicon substrate 40', the silicon substrate is partially etched and removed from the side of a second surface 40*b* of the single crystal silicon substrate 40' by backside photolithography arid D-RIE. At this time, since the etching rate of the silicon substrate is not perfectly uniform, the time at which a leading end of an etched surface reaches the nozzle plate 12 varies. For this reason, if the etching rate is high, after a leading end of an etched surface reaches the nozzle plate 12, etching also occurs in a lateral direction to sometimes form a notch in the inner wall of the ink pressure chamber 14*a* near the nozzle plate 12. When a notch is formed in this manner, the diameter of the ink pressure chamber 14*a* varies, resulting in variations in driving force for ink droplets.

In order to prevent such a problem, the inkjet head 70 according to this embodiment has the frame portion 72 protruding from the second surface of the nozzle plate 12. Providing the frame portion 72 can define an etching area expanding in a lateral direction and always control the diameter of the ink pressure chamber 14*a* to the same diameter.

A method of manufacturing the inkjet head 70 according to the second embodiment will be described below.

Figure 21:
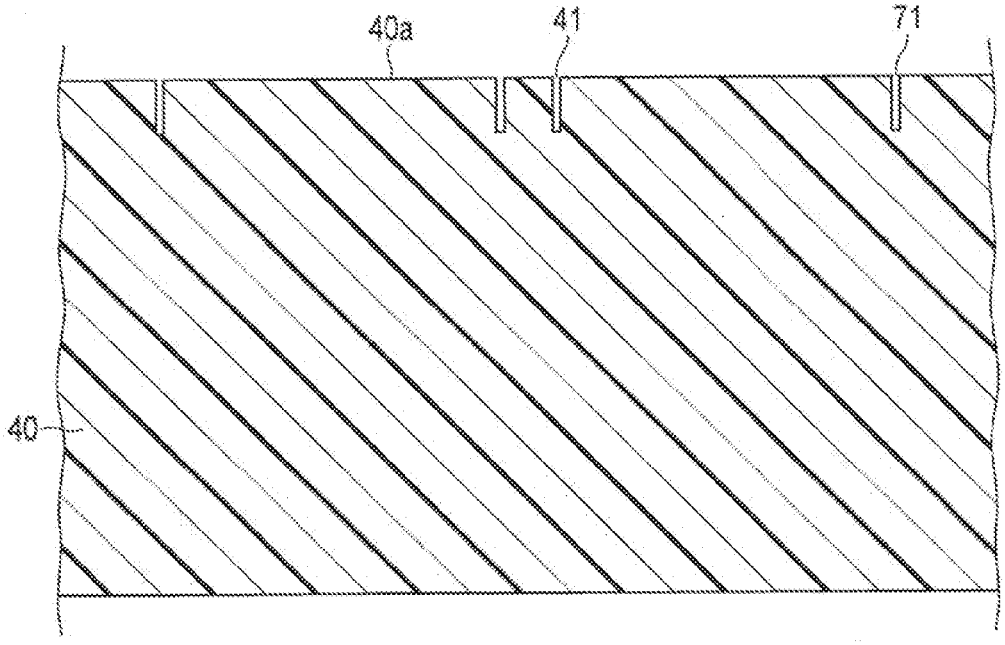
FIG. 21 is a view for explaining the method of manufacturing the inkjet head according to the second embodiment.

As shown in FIG. 21, first of all, a groove 41 for a nozzle 20 is formed in a flat wafer surface 40*a* (first surface) of a single crystal silicon substrate 40, and another ring-like groove 71 for a frame portion 72 is formed outside the groove 41. In this embodiment, the grooves 41 and 72 are formed almost perpendicularly to the wafer surface 40*a*. The position and shape (depth and width) of the groove 41 determine the position, length, and thickness of the nozzle 20 to be formed in a subsequent process. The position and shape (depth and width) of the other groove 71 determine the position, length, and thickness of the frame portion 72 to be formed in a subsequent process.

Figure 22:
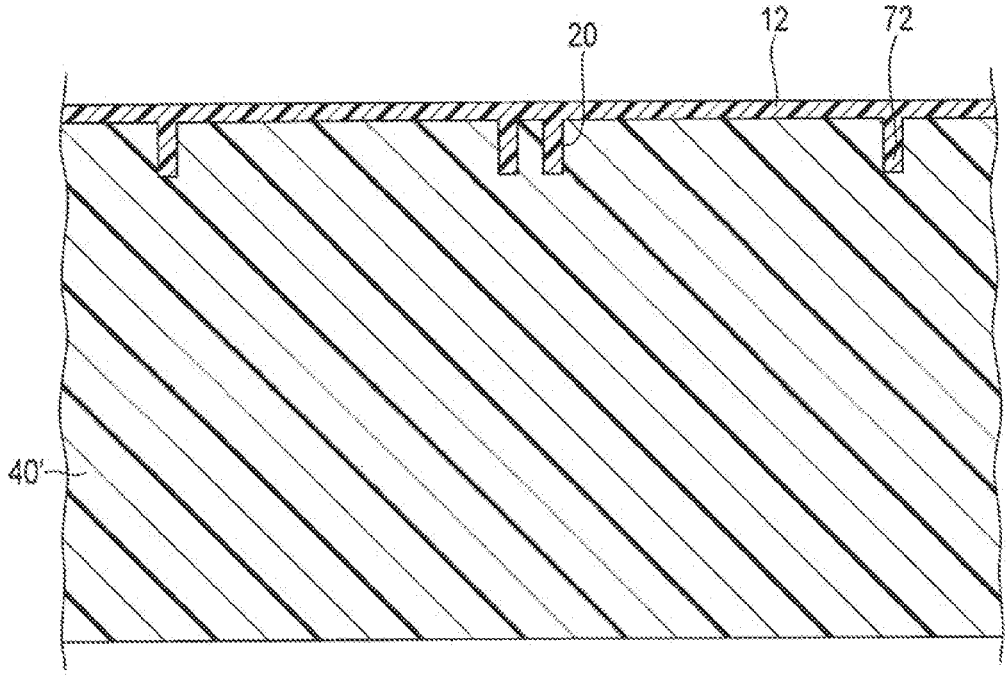
FIG. 22 is a view for explaining the method of manufacturing the inkjet head according to the second embodiment.

As shown in FIG. 22, the nozzle plate 12, the nozzle 20, and the frame portion 72, which are formed from a silicon oxide film, are simultaneously formed by thermal oxidation of the wafer surface 40*a*. That is, the nozzle 20 and the frame portion 72 can be formed from the same material as that for the nozzle plate 12 integrally with the nozzle plate 12. This can increase the positional accuracy of the nozzle 20 and the frame portion 72 with respect to the nozzle plate 12 and the mechanical strength. The wall thickness and length of the frame portion 72 can be easily adjusted to desired values by adjusting the width and depth of the groove 71.

Note that in this embodiment, the nozzle plate 12, the nozzle 20, the frame portion 72 are formed by oxidizing the surface 40*a* of the silicon substrate 40 by heating. However, it is possible to use a plasma CVD method, a CVD method using TEOS as a raw material, or the like instead of the thermal oxidation method. In addition, in the embodiment, the nozzle plate 12, the nozzle 20, and the frame portion 72 are formed by thermal oxidation of the silicon substrate 40. However, it is possible to form them by using both the thermal oxidation method and the plasma method or the CVD method using TEOS as a raw material or the like.

Figure 23:
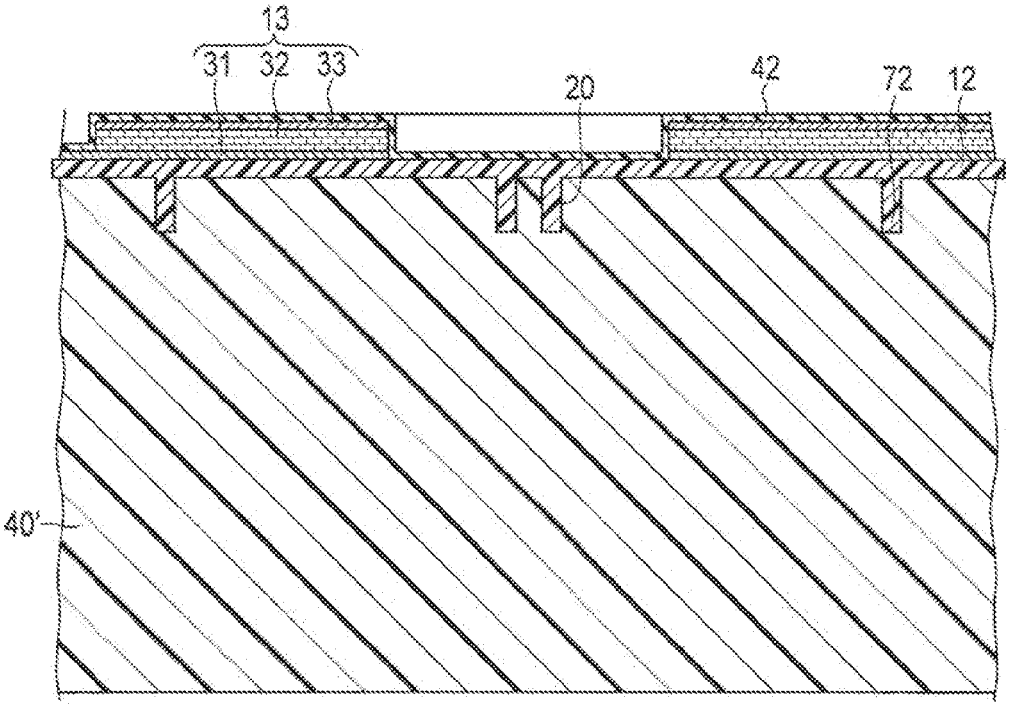
FIG. 23 is a view for explaining the method of manufacturing the inkjet head according to the second embodiment.

As shown in FIG. 23, the annular piezoelectric element 13 is deposited on the first surface of the nozzle plate 12 on the opposite side to the nozzle 20 and the frame portion 72. Thereafter, a water-repellent protective film 42 is then forced so as to cover the entire upper surfaces of the nozzle plate 12 and the piezoelectric element 13. The steps of depositing the piezoelectric element 13 and the protective film 42 are the same as those in the first embodiment described above, and hence a description of them will be omitted.

Figure 24:
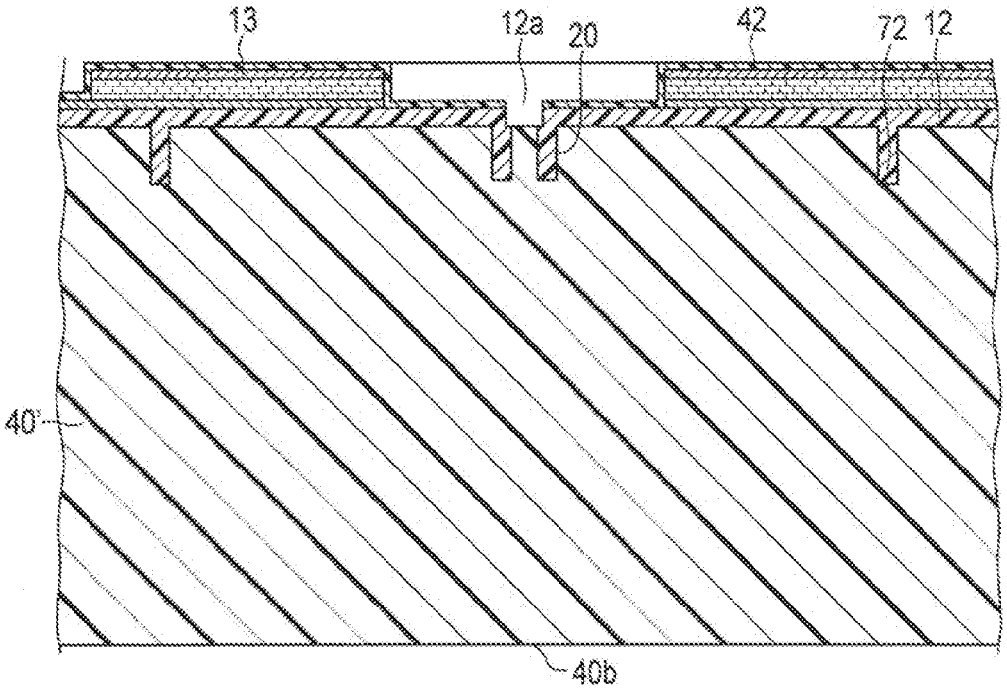
FIG. 24 is a view for explaining the method of manufacturing the inkjet head according to the second embodiment.

As shown in FIG. 24, the protective film 42 and the nozzle plate 12 are then patterned by performing photolithography and reactive ion etching from the outside of the protective film 42, thereby forming a nozzle orifice 12*a* facing the nozzle 20. At this time, the nozzle orifice 12*a* is formed to have a diameter slightly larger than the diameter of a channel inside the nozzle 20.

Figure 25:
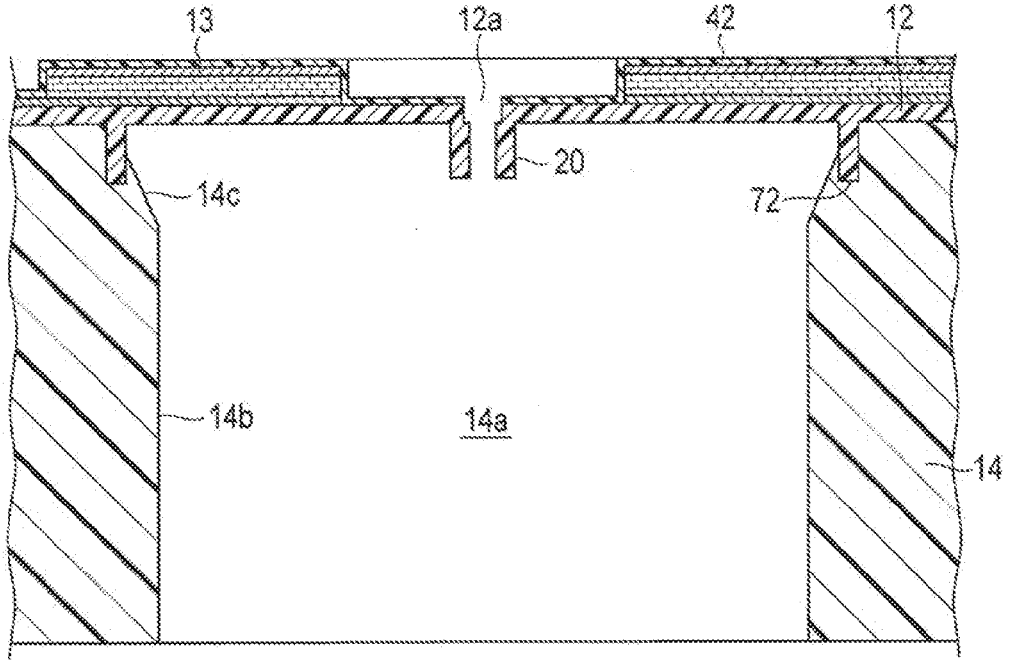
FIG. 25 is a view for explaining the method of manufacturing the inkjet head according to the second embodiment.

As shown in FIG. 25, the ink pressure chamber 14*a* is then formed by partially removing the single crystal silicon substrate 40' from the side of a second surface 40*b* which is opposite to the nozzle plate 12 by backside photolithography and D-RIE. At this time, the silicon material inside the nozzle 20 is also removed to make the nozzle orifice 12*a* communicate with the ink pressure chamber 14*a*.

More specifically, at an early stage of D-RIE, a perpendicular inner surface 14*b* of the ink pressure chamber 14*a* is formed by repeating etching and side surface passivation using a pattern having a diameter smaller than that of the ink pressure chamber 14*a*. After the etching edge reaches a predetermined depth, an inner surface 14*c* of the ink pressure chamber 14*a* which is tapered to gradually increase in diameter is formed by performing etching under the condition that side wall passivation is weakened to gradually increase the outer diameter.

In this case, since the etching rate ratio between the silicon and the silicon oxide film can be set to 100:1, the ink pressure chamber 14*a* can be formed without almost over-etching the nozzle plate 12 and the frame portion 72. This makes it possible to always constantly control the volume of the ink pressure chamber 14*a* and suppress variations in conditions for the discharge of ink droplets. Therefore, ink droplets with a uniform volume can be discharged.

Figure 26:
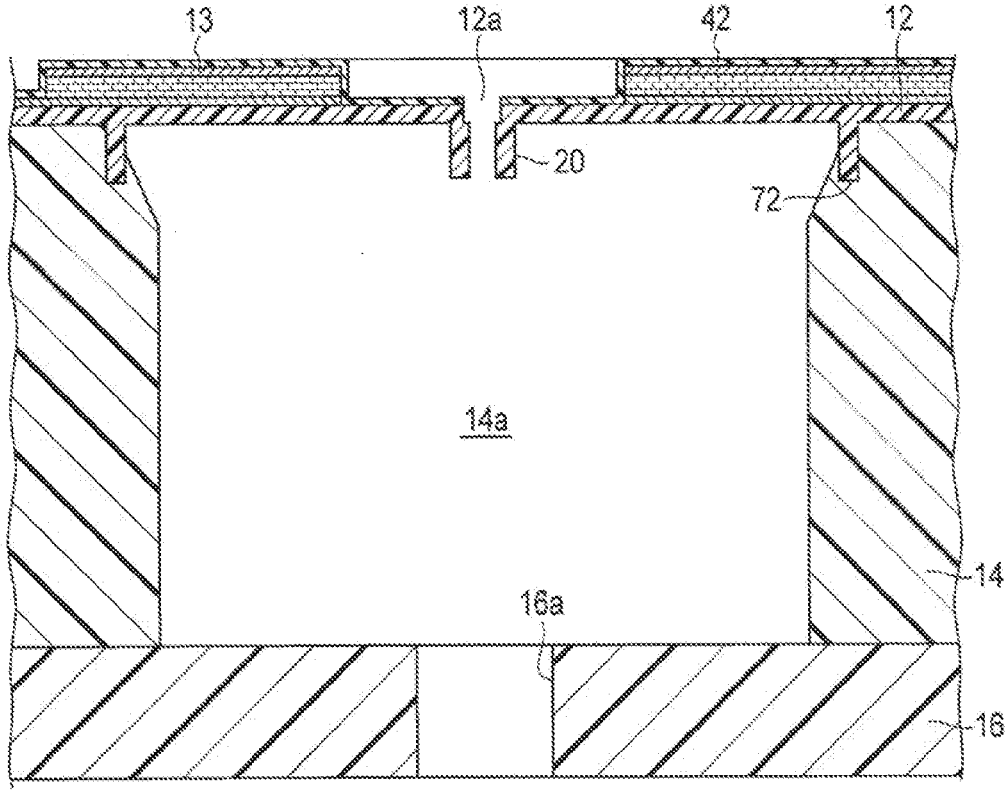
FIG. 26 is a view for explaining the method of manufacturing the inkjet head according to the second embodiment.

As shown in FIG. 26, the back plate 16 is bonded to the second surface 40*b* of the single crystal silicon substrate 40'. As a bonding method, it is possible to use, for example, a silicon direct bonding method of bonding two substrate surfaces to each other by tightly pressing them in a vacuum atmosphere after cleaning them or a method using an organic adhesive. Thereafter, the ink passage hole 16*a* is formed in the back plate 16 by, for example, a laser.

As described above, since the nozzle 20 is included in the second surface of the nozzle plate 12, this embodiment can provide a highly reliable, compact piezoelectric MEMS type inkjet head which facilitates integration, can be manufactured by a simple process, increase the driving volume, increase driving energy, and perform tone control concerning the discharge amount of ink droplet by driving control.

(Third Embodiment)

Figure 27:
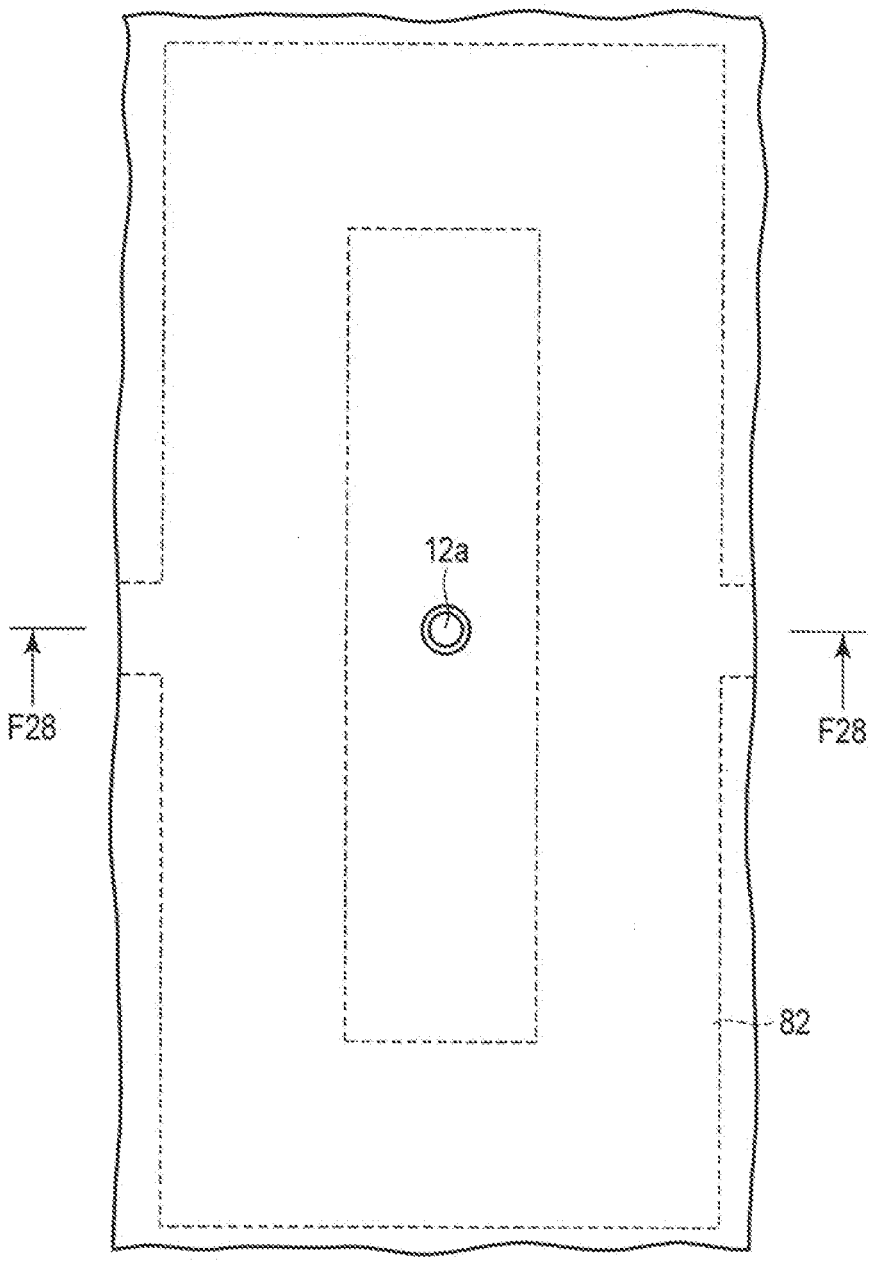
FIG. 27 is a partially enlarged plan view of the main portion of an inkjet head according to the third embodiment.
Figure 28:
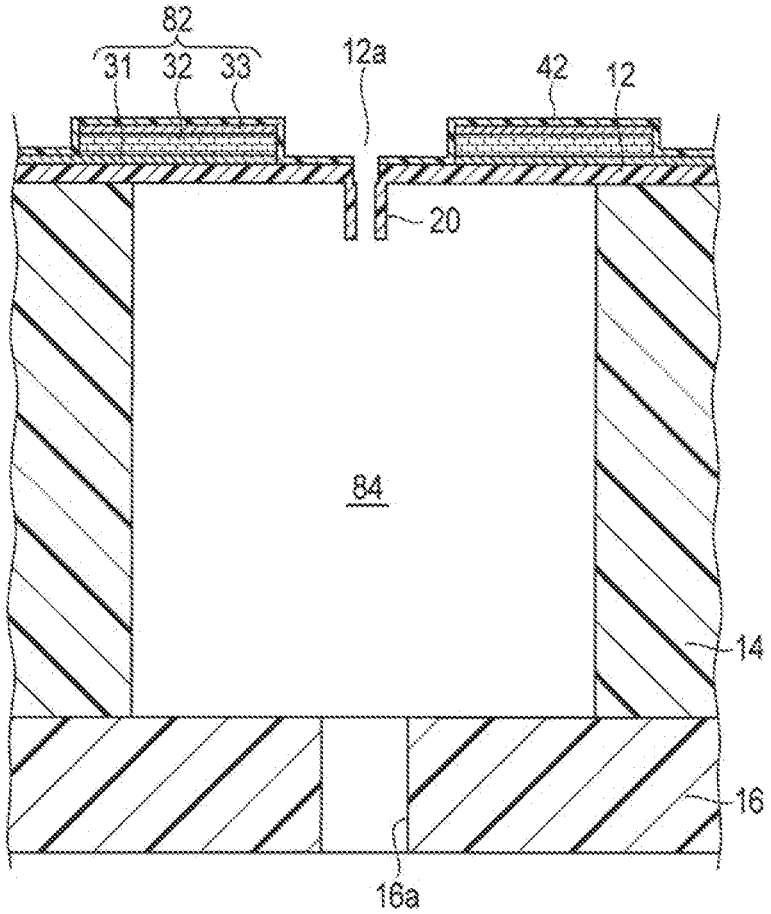
FIG. 28 is a partially enlarged sectional view of the inkjet head taken along F28-F28 in FIG. 27.

FIG. 27 is a partially enlarged plan view of the main portion of an inkjet head 80 according to the third embodiment. FIG. 28 is a partially enlarged sectional view of the inkjet head 80 taken along F28-F28 in FIG. 27.

In the inkjet head 80 according to this embodiment, a piezoelectric element 82 has a rectangular shape, and an ink pressure chamber 84 also has a rectangular shape. However, the inkjet head 80 has almost the same structure as that of the inkjet head 6 according to the first embodiment except for the shapes of the piezoelectric element 82 and the ink pressure chamber 84. Therefore, the same reference numerals denote constituent elements having the same functions as those in the first embodiment, and a detailed description of them will be omitted.

The inkjet head 80 according to this embodiment generates larger ink discharge energy than the inkjet head 6 according to the first embodiment because the ink pressure chamber 84 has a rectangular planar shape.

Note that the planar shape of the ink pressure chamber is not limited to a circular shape as in the first embodiment or a rectangular shape as in the third embodiment, and may be another shape such as an oblong shape, elliptic shape, or polygonal shape.

(Fourth and Fifth Embodiments)

Figure 29:
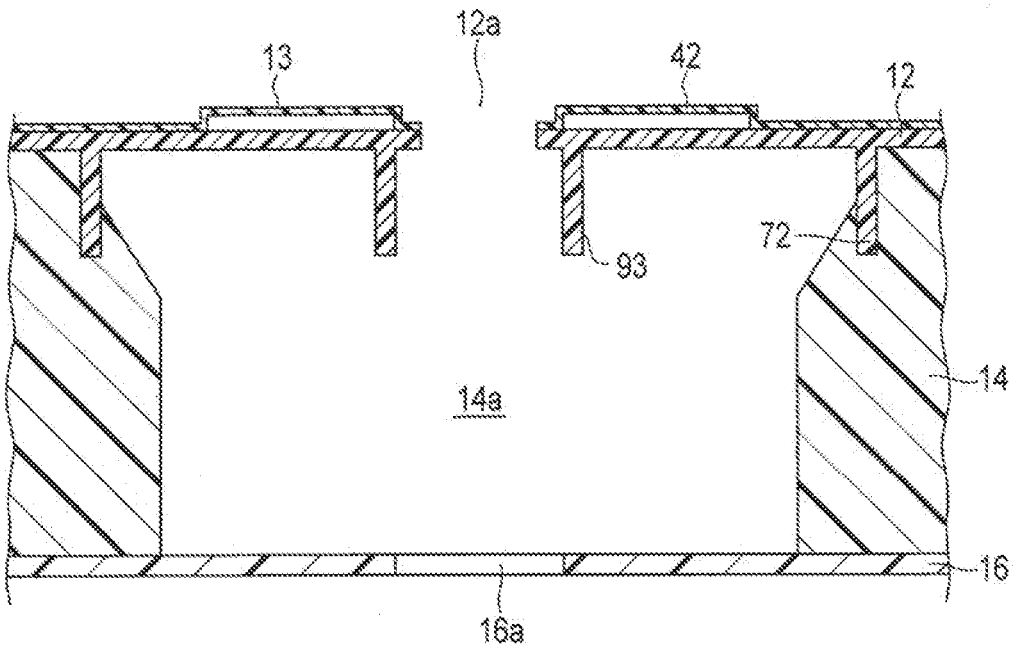
FIG. 29 is a partially enlarged plan view of the main portion of an inkjet head according to the fourth embodiment.
Figure 30:
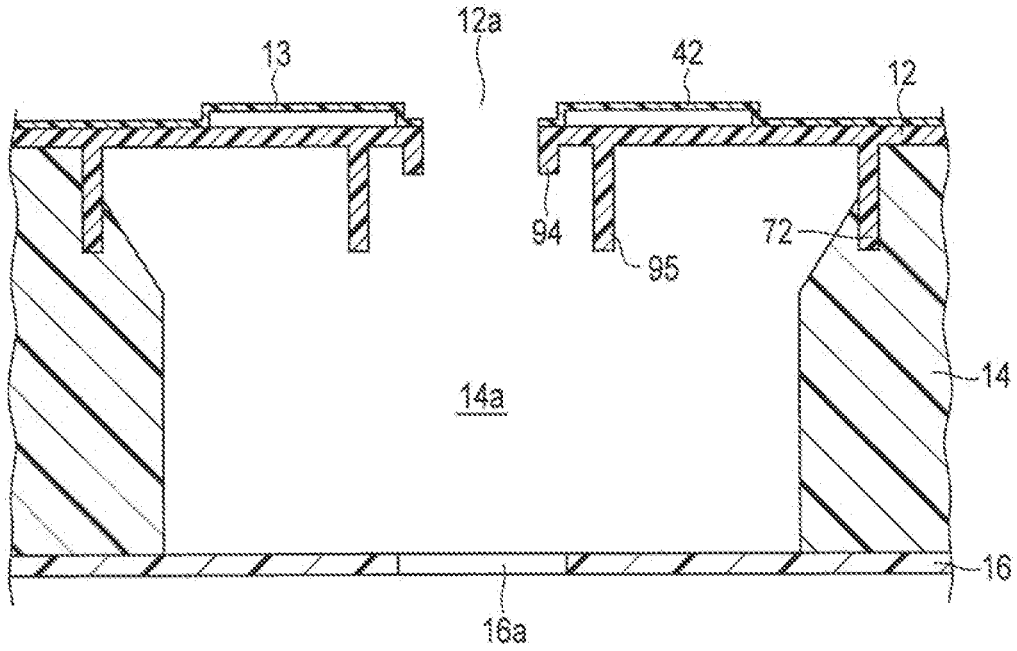
FIG. 30 is a partially enlarged plan view of the main portion of an inkjet head according to the fifth embodiment.

FIG. 29 is a partially enlarged sectional view of the main part of an inkjet head 91 according to the fourth embodiment. FIG. 30 is a partially enlarged sectional view of the main portion of an inkjet head 92 according to the fifth embodiment. The inkjet heads 91 and 92 have almost the same structure as that of the inkjet head 70 according to the second embodiment except that the shapes of nozzles 93, 94, and 95 are different. Therefore, the same reference numerals denote constituent elements having the same functions as those in the second embodiment, and a detailed description of them will be omitted.

The inkjet head 91 according to the fourth embodiment includes the nozzle 93 having an ink channel with a relatively large diameter. As described above, making the nozzle 93 have a larger inner diameter than an nozzle orifice 12*a* can reduce the variation width of the ink meniscus at the time of discharging an ink droplet and suppress the generation of air bubbles.

The inkjet head 92 according to the fifth embodiment includes an inner nozzle 94 (inner cylindrical portion) having an ink channel with a relatively small inner diameter and an outer nozzle 95 (outer cylindrical portion) arranged outside the inner nozzle 94 and having an ink channel with a relatively large inner diameter.

The inkjet head according to at least one of the embodiments described above includes the nozzles formed from the same material as that for the second surface of the nozzle plate on the ink pressure chamber side and integrally formed form the second surface, thereby providing a low-profile inkjet head with high mechanical strength, which can be easily manufactured.

The embodiments of the present invention have been described above while referring to concrete examples. The above embodiments are merely exemplary and not intended to limit the present invention. In addition, in the description of each embodiment, a description of parts and the like which are not directly required to explain the present invention concerning the inkjet head an the method of manufacturing the same is omitted. However, it is possible to selectively use necessary elements related to each inkjet head and each method of manufacturing the same as needed.

In addition, all inkjet heads which include the elements of the present invention and whose designs can be properly changed by those skilled in the art are incorporated in the scope of the present invention. The scope of the present invention is defined by the appended claims and their equivalents.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the methods described herein may be made without departing from the spirit of the inventions. The accompanying claims and their equivalents are intended to cover such forms or modifications as would fall within the scope and spirit of the inventions.

The invention claimed is:

1. An inkjet head comprising:

a nozzle plate including a first surface, a second surface opposite to the first surface, a through hole configured to make the first surface communicate with the second surface, and a cylindrical member continuously and integrally extending from the second surface by extending the through hole;

an ink pressure chamber provided on the second surface side of the nozzle plate and communicating with the cylindrical member and the through hole; and an actuator configured to discharge ink in the ink pressure chamber from the through hole by displacing the nozzle plate, wherein the cylindrical member includes a tapered ink channel whose sectional area gradually decreases toward the through hole.

2. The head of claim 1, wherein the nozzle plate and the cylindrical member integrally extending from the nozzle plate are formed from a silicon oxide film.

3. The head of claim 1, wherein the actuator comprises a piezoelectric element including a lower electrode, a piezoelectric film, and an upper electrode stacked on the first surface of the nozzle plate around the through hole.

4. The head of claim 1, wherein the cylindrical member includes an ink channel having a larger diameter than the through hole.

5. The head of claim 1, wherein the cylindrical member includes an inner cylindrical portion and an outer cylindrical portion arranged outside the inner cylindrical portion and having a larger length than the inner cylindrical portion.

6. The head of claim 1, wherein the nozzle plate includes a defining frame made of the same material as that for the second surface and continuously and integrally extending from the second surface.

* * * * *